US011717949B2

(12) United States Patent
Yagi et al.

(10) Patent No.: US 11,717,949 B2
(45) Date of Patent: Aug. 8, 2023

(54) STAPLE REMOVING DEVICE AND GUIDE

(71) Applicant: MAX CO., LTD., Tokyo (JP)

(72) Inventors: Nobuaki Yagi, Tokyo (JP); Katsuya Hakozaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/065,120

(22) Filed: Oct. 7, 2020

(65) Prior Publication Data

US 2021/0101269 A1 Apr. 8, 2021

(30) Foreign Application Priority Data

Oct. 7, 2019 (JP) ..... 2019-184852
Sep. 4, 2020 (JP) ..... 2020-149466

(51) Int. Cl.
*B25C 11/00* (2006.01)
*B65H 41/00* (2006.01)

(52) U.S. Cl.
CPC ..... *B25C 11/00* (2013.01); *B65H 41/00* (2013.01)

(58) Field of Classification Search
CPC ..... B25C 11/00; B65H 41/00
See application file for complete search history.

(56) References Cited

U.S. PATENT DOCUMENTS 4,917,366 A * 4/1990 Murakami ..... B65H 37/04 227/7
2003/0067107 A1* 4/2003 Ikeda ..... B65H 3/00 270/58.33
2005/0242151 A1 11/2005 Bargo et al.

FOREIGN PATENT DOCUMENTS

| | | | |
|---|---|---|---|
| CN | 1976782 | A | 6/2007 |
| GB | 1025210 | A | 4/1966 |
| JP | H08-141935 | A | 6/1996 |
| JP | 2019-022923 | A | 2/2019 |
| WO | 2018/0230060 | A1 | 12/2018 |

OTHER PUBLICATIONS

European Extended Search Report for 20200345.5 dated Feb. 21, 2021 (6 pages).

* cited by examiner

*Primary Examiner* — Nirvana Deonauth
(74) *Attorney, Agent, or Firm* — Weihrouch IP

(57) ABSTRACT

A staple removing device includes an aligning part with which a fold of a booklet stitched by a staple having a crown portion and leg portions and folded along an extension direction of the crown portion is brought into contact, a guide part that guides the fold of the booklet to the aligning part; and a removing part having an operating part that moves in a direction intersecting with the fold of the booklet, to engage with the crown portion of the staple that stitches the booklet.

12 Claims, 41 Drawing Sheets

STAPLE REMOVING DEVICE AND GUIDE

CROSS-REFERENCE TO RELATED APPLICATIONS

This application is based upon and claims the benefit of priority from prior Japanese patent application No. 2019-184852, filed on Oct. 7, 2019 and Japanese patent application No. 2020-149466, filed on Sep. 4, 2020, the entire contents of which are incorporated herein by reference.

TECHNICAL FIELD

The present invention relates to a staple removing device configured to pull out a staple from a booklet bound in a two-fold bookbinding manner, and a guide that is attached to the staple removing device.

BACKGROUND ART

In the related art, as a device configured to remove a staple from a sheet bundle stitched by the staple, known are devices configured to pull out a staple from a sheet bundle by inserting a wedge-shaped member between the sheet bundle and a crown portion of the staple that stitches the sheet bundle (refer to JP-A-H08-141935 and JP-A-2019-022923).

In the devices, the sheet bundle of which portions close to a sheet end are stitched by staples, such as general end stitching and corner stitching, is a target for removing staples. A dimension in a depth direction of a sheet bundle insertion opening of the device is suppressed to the bare minimum so that the device does not become large.

In the meantime, there is also a form where a center of a sheet is stitched by a staple for two-fold bookbinding. However, in the above-described devices, since the dimension in the depth direction of the sheet bundle insertion opening is suppressed to the bare minimum, even though the booklet bound in the two-fold bookbinding manner is opened, it is not possible to set the staple in a position in which the staple is removed by the wedge-shaped member, because the center of the sheet is stitched by the staple.

Considering a configuration of a device that can remove a staple while aligning a position of the staple with a position in which the staple is removed by the wedge-shaped member in a state where the booklet is opened, it is necessary to set a dimension in a depth direction of an opening in which the booklet is inserted to a length within which one side of the opened booklet can enter, which enlarges the device.

SUMMARY OF INVENTION

It is therefore an object of the present invention to provide a staple removing device capable of removing a staple from a booklet in a state where the booklet bound in a two-fold bookbinding manner is closed, and a guide that is attached to the staple removing device.

A staple removing device includes an aligning part with which a told of a booklet stitched by a staple having a crown portion and leg portions and folded along an extension direction of the crown portion is brought into contact, a guide part that guides the fold of the booklet to the aligning part; and a removing part having an operating part that moves in a direction intersecting with the fold of the booklet, to engage with the crown portion of the staple that stitches the booklet.

In the staple removing device, the fold of the booklet is guided to the aligning part by the guide part. The removing part is engaged with the crown portion of the staple that stitches the booklet of which the fold is brought into contact with the aligning part, and applies the force to the staple in the direction of pulling out the staple from the booklet, so that the staple is removed from the booklet. Disclosed is a guide that is attached to a staple removing device including an aligning part with which a fold of a booklet stitched by a staple having a crown portion and leg portions and folded along an extension direction of the crown portion is brought into contact; and a removing part having an operating part configured to move in a direction intersecting with the fold of the booklet, to engage with the crown portion of the staple that stitches the booklet and to apply a force to the staple in a direction of pulling out the staple from the booklet. The guide includes a guide part configured to guide the fold of the booklet to the aligning part.

DESCRIPTION OF EMBODIMENTS

<Configuration Example of Staple Removing Device of First Embodiment>

Figure 1A:
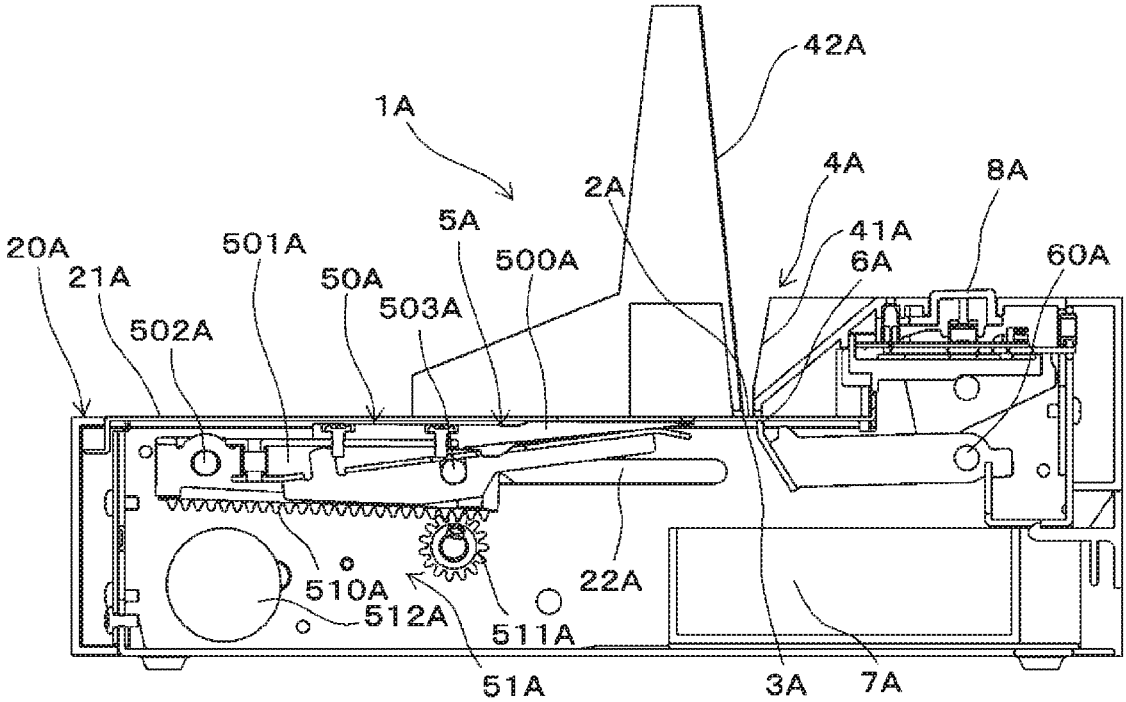
FIG. 1A is a side sectional view depicting an example of a staple removing device of a first embodiment.
Figure 1B:
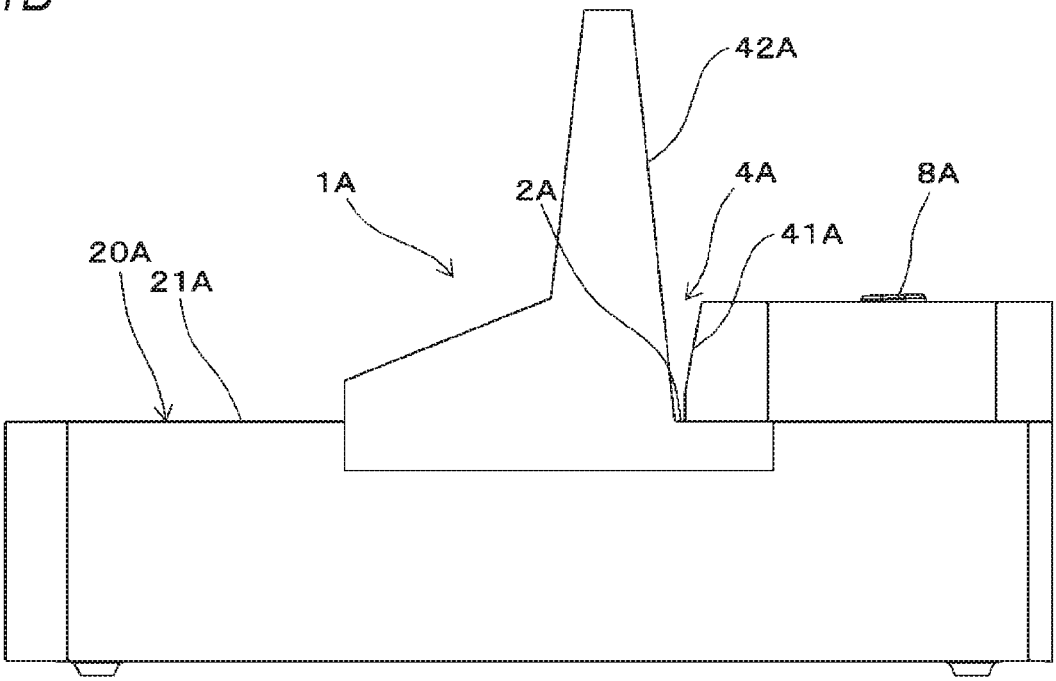
FIG. 1B is a side view depicting the example of the staple removing device of the first embodiment.
Figure 1C:
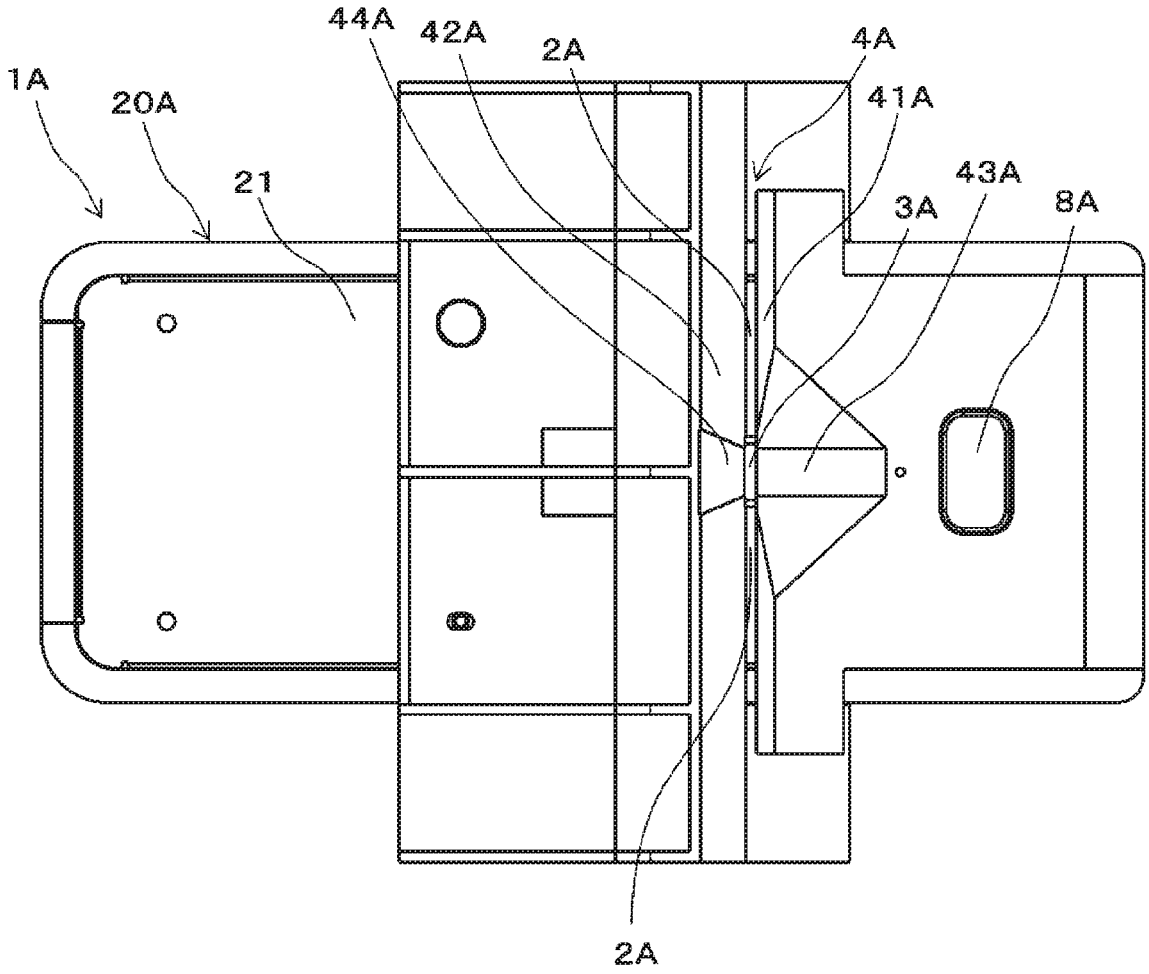
FIG. 1C is a plan view depicting the example of the staple removing device of the first embodiment.
Figure 2A:
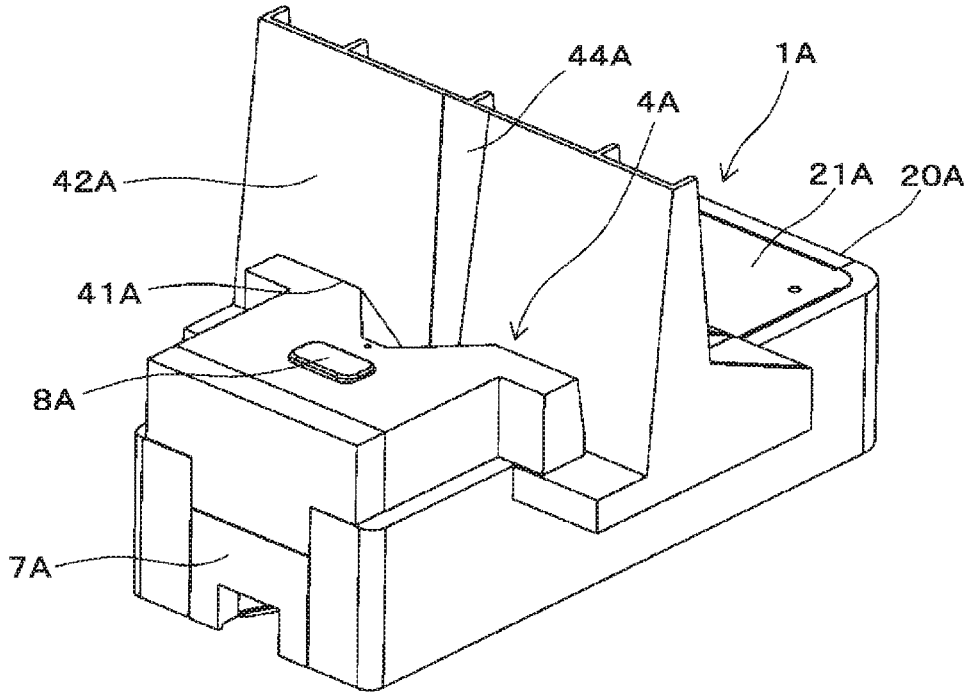
FIG. 2A is a perspective view depicting the example of the staple removing device of the first embodiment.
Figure 2B:
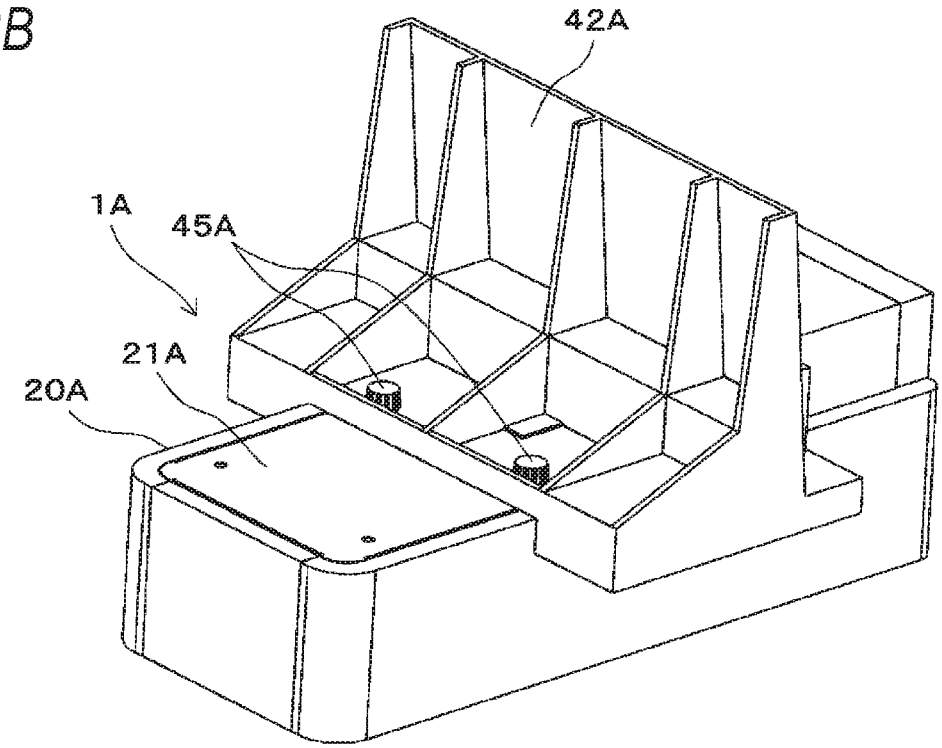
FIG. 2B is a perspective view depicting the example of the staple removing device of the first embodiment.
Figure 3A:
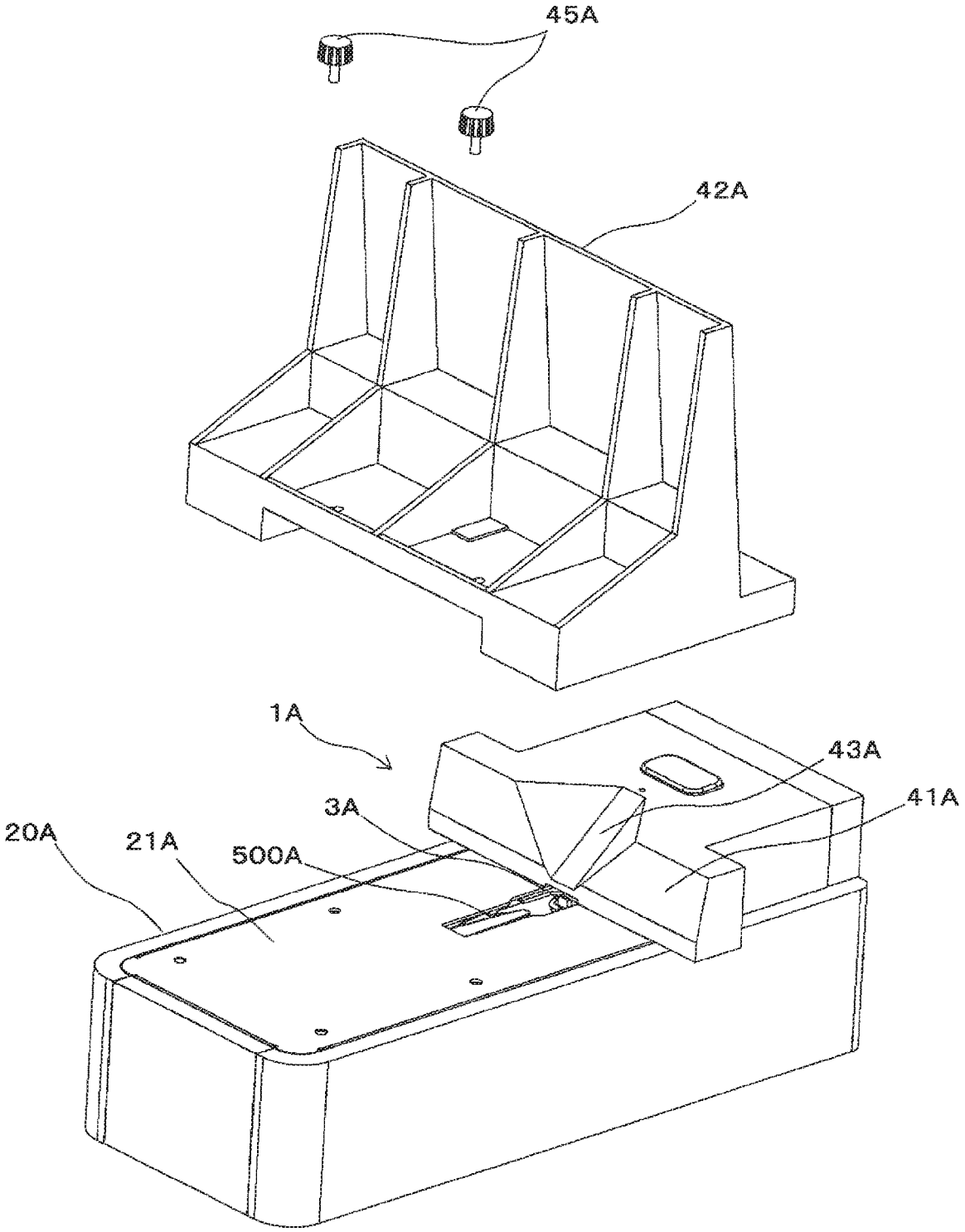
FIG. 3A is an exploded perspective view depicting the example of the staple removing device of the first embodiment.
Figure 3B:
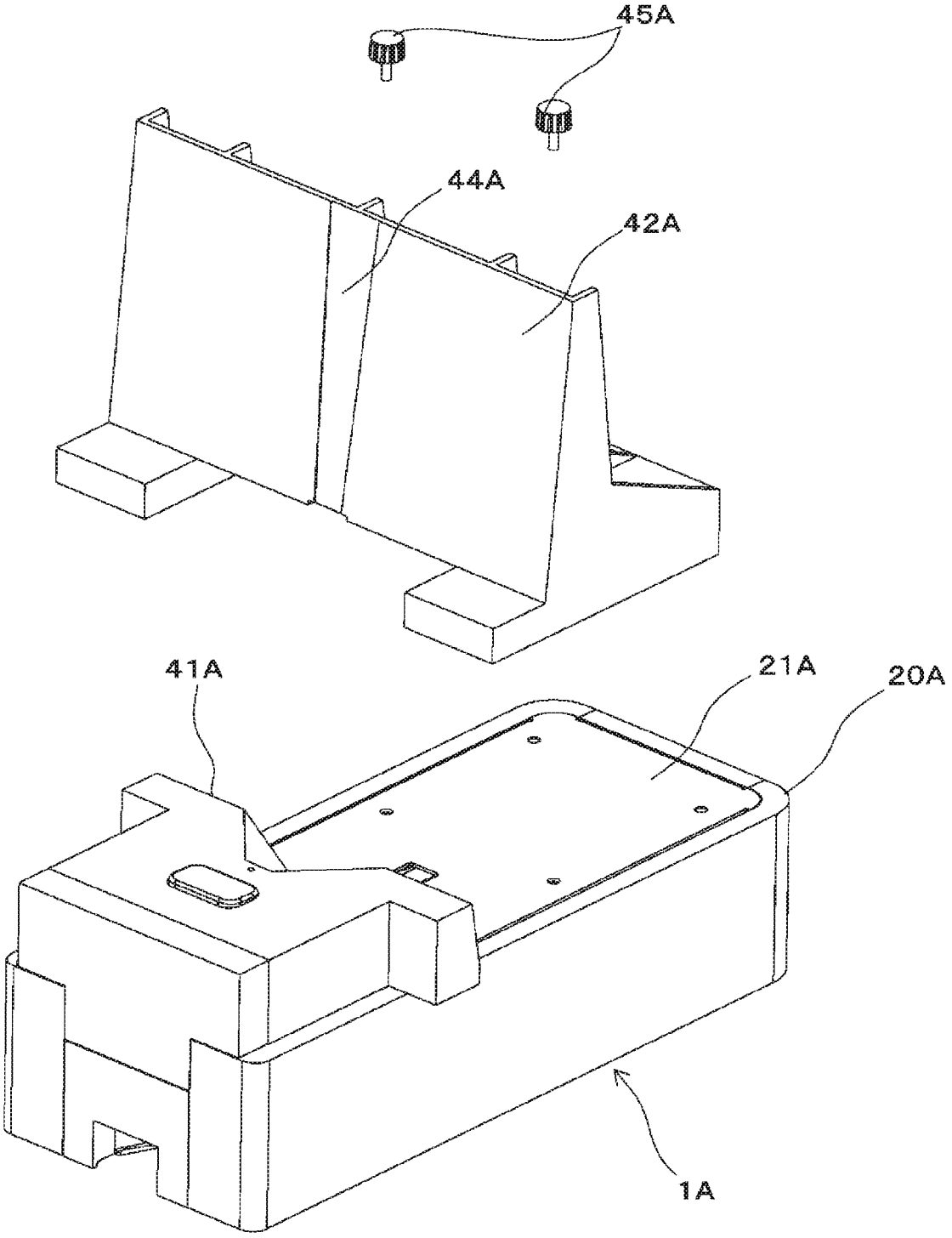
FIG. 3B is an exploded perspective view depicting the example of the staple removing device of the first embodiment.
Figure 4A:
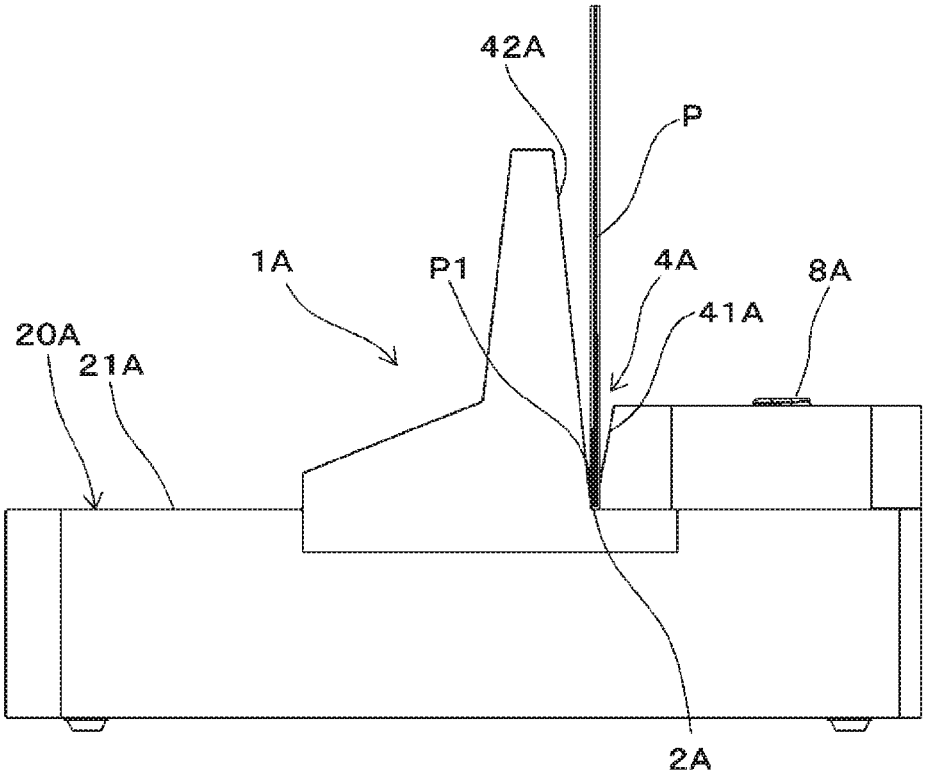
FIG. 4A is a side view depicting a state where a booklet is set to the example of the staple removing device of the first embodiment.
Figure 4B:
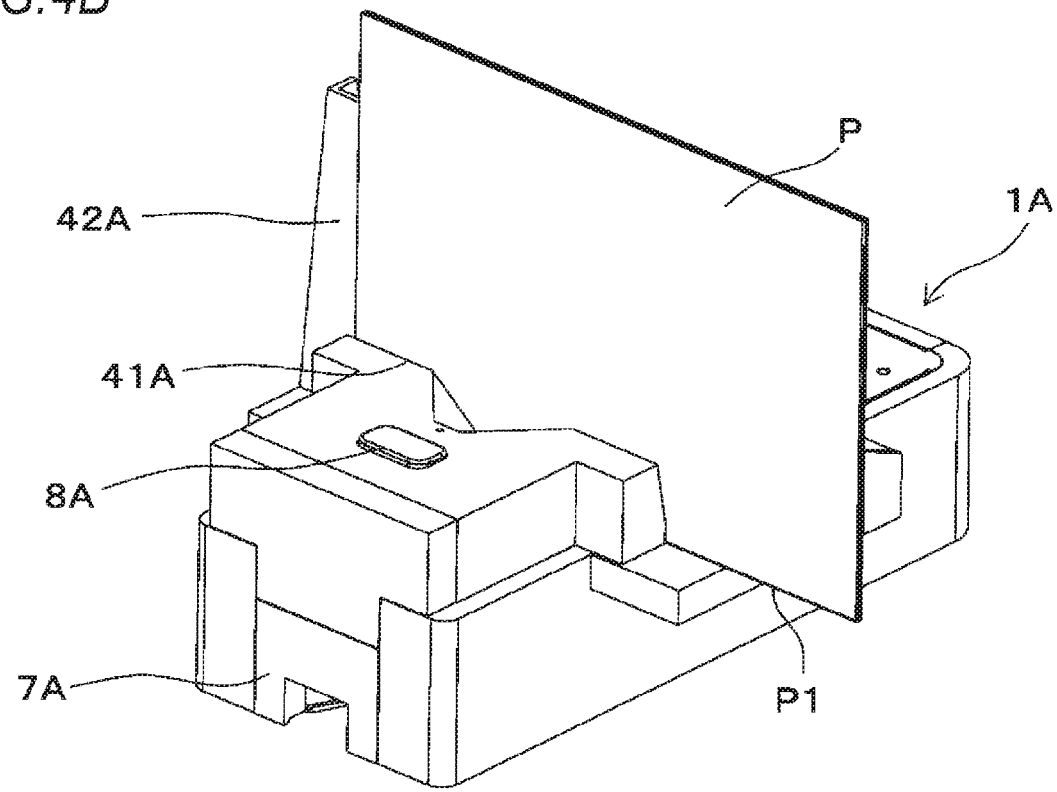
FIG. 4B is a perspective view depicting the state where the booklet is set to the example of the staple removing device of the first embodiment.
Figure 5:
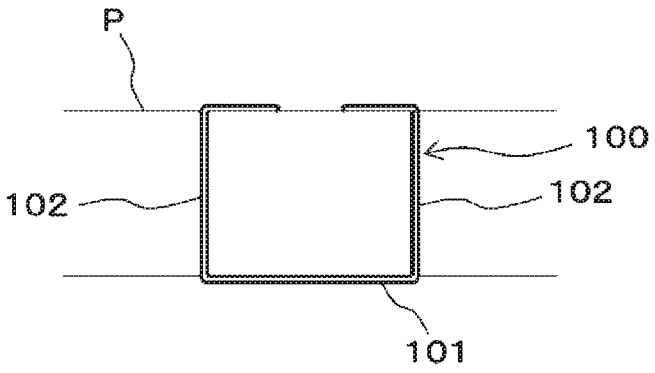
FIG. 5 illustrates an example of a staple that stitches a booklet P.
Figure 6:
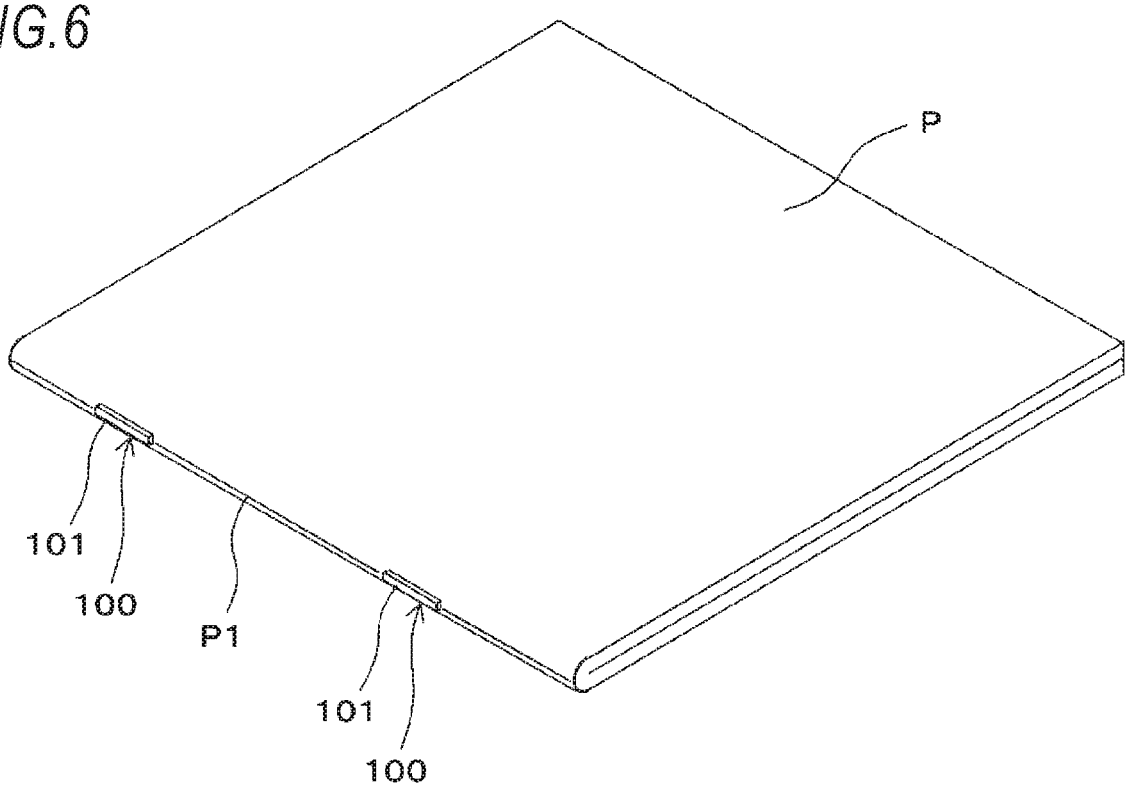
FIG. 6 is a perspective view depicting an example of a booklet stitched by staples.

FIG. 1A is a side sectional view depicting an example of a staple removing device of a first embodiment, FIG. 1B is a side view depicting the example of the staple removing device of the first embodiment, and FIG. 1C is a plan view depicting the example of the staple removing device of the first embodiment. Also, FIGS. 2A and 2B are perspective views depicting the example of the staple removing device of the first embodiment, and FIGS. 3A and 3B are exploded perspective views depicting the example of the staple removing device of the first embodiment. Also, FIG. 4A is a side view depicting a state where a booklet is set to the example of the staple removing device of the first embodiment, and FIG. 4B is a perspective view depicting a state where the booklet is set to the example of the staple removing device of the first embodiment. Also, FIG. 5 illustrates an example of a staple that stitches a booklet P, and FIG. 6 is a perspective view depicting an example of a booklet stitched by staples.

First, a staple 100 that stitches a booklet P and the booklet P stitched by the staples 100 are described with reference to FIGS. 5 and 6.

The staple 100 has a crown portion 101 and a pair of leg portions 102, which are formed by bending both ends of the crown portion in one direction. The pair of leg portions 102 of the staple 100 penetrating the booklet P is each bent inwardly. Thereby, the booklet P is stitched by the staple 100.

The booklet P has a two-fold bookbinding form where stitching positions by the staples 100 are folded along an extension direction of the crown portion 101 in a saddle stitching aspect where a center of a sheet is stitched by the staple 100. Thereby, the booklet P has a fold P1 formed along the extension direction of the crown portion 101 of the staple 100. Also, the booklet P is folded in a direction in which the crown portion 101 is positioned on a convex side (mountain-side) of the fold P1 and the leg portions 102 are positioned on a concave side (valley-side).

Subsequently, a staple removing device 1A of the first embodiment for pulling out the staple 100 from the booklet P is described with reference to each drawing.

As shown in FIGS. 1, 4A and 4B, the staple removing device 1A of the first embodiment has such a configuration that the booklet P is set in a vertical direction. The staple removing device 1A has an aligning part 2A with which the fold P1 of the booklet P is brought into contact, an opening portion 3A that the crown portion 101 of the staple 100 that stitches the booklet P enters when the fold P1 of the booklet P is brought into contact with the aligning part 2A, and a guide part 4A configured to guide the fold P1 of the booklet P to the aligning part 2A.

The aligning part 2A is configured by a plane having such a shape that a length in a direction along the fold P1 of the booklet P in contact with the aligning part 2A is longer than a length in a direction along a thickness direction of the booklet P. The aligning part 2A has a length direction that is the direction along the fold. P1 of the booklet P and a width direction that is the direction along the thickness direction of the booklet P, and is provided on both sides of the opening portion 3A along the length direction. The aligning part 2A may also be provided on at least one side of the opening portion 3A along the width direction. In the present example, the aligning part 2A is configured by a first surface 21A of a housing 20A that configures an exterior of the staple removing device 1A. The staple removing device 1A of the first embodiment is placed so that the first surface 21A is horizontal.

The opening portion 3A is configured by providing the aligning part 2A with a long hole whose dimension along the length direction of the aligning part 2A is greater than a length in the length direction of the crown portion 101 of the staple 100 and a dimension along the width direction of the aligning part 2A is greater than a length in the width direction of the crown portion 101. As shown in FIG. 3A, in the present example, the opening portion 3A penetrates a front surface and a back surface of the first surface 21A of the housing 20A, and is configured as a part, of an opening extending along the width direction of the aligning part 2A.

The guide part 4A has a first guide part 41A and a second guide part 42A protruding in directions intersecting with the length direction and the width direction of the aligning part 2A. In other words, the guide part 4A protrudes in directions intersecting with the aligning part 2A. The first guide part 41A and the second guide part 42A face each other in the width direction of the aligning part 2A with the opening portion 3A being interposed therebetween.

The guide part 4A is configured so that an interval between the first guide part 41A and the second guide part 42A along the width direction of the aligning part 2A is substantially equal to or greater than a thickness of the booklet P having the two-fold bookbinding form in the vicinity of a part at which the booklet P is in contact with the aligning part 2A, in other words, at a portion at which an end portion of the first guide part 41A, which protrudes from the aligning part 2A, on the aligning part 2A-side and an end portion of the second guide part 42A on the aligning part 2A-side face each other. Also, facing surfaces of the first guide part 41A and the second guide part 42A are formed as inclined surfaces inclined relative to a direction orthogonal to the aligning part 2A and are configured to have a tapered shape so that the interval between the first guide part 41A and the second guide part 42A along the width direction of the aligning part 2A increases away from the aligning part 2A.

In the present example, the second guide part 42A that is a component independent of the housing 20A is attached to the first surface 21A by screws 45A, so that the guide part 4A is configured. Note that, a configuration where the attachment position of the second guide part 42A can be selected and the interval between the first guide part 41A and the second guide part 42A along the width direction of the aligning part 2A can be changed depending on the thickness of the booklet P is also possible.

The guide part 4A has index parts 43A and 44A for aligning a position of the staple 100 that stitches the booklet P with the opening portion 3A. The index part 43A is configured by a concave portion provided on a surface of the first guide part 41A facing the second guide part 42A in conformity to the position of the opening portion 3A and extending away from the opening portion 3A. The index part 44A is configured by a concave portion provided on a surface of the second guide part 42A facing the first guide part 41A in conformity to the position of the opening portion 3A and extending away from the opening portion 3A (or aligning part 2A). The index part 43A and 44A may be provided for aligning the position of the staple 100 with the operating part, that is described later, instead of the opening portion 3A.

Note that, the index parts 43A and 44A may also be provided by printing a plurality of lines defining a range in Which the opening portion 3A is provided, a band in conformity to the opening portion 3A, and the like. Also, the index part may not be provided on any of the first guide part 41A and the second guide part 42A.

When the booklet P is inserted between the first guide part 41A and the second guide part 42A, the staple removing device 1A guides the fold P1 of the booklet P to the aligning part 2A. Ina state where the position of the crown portion 101 of the staple 100 that stitches the booklet P is aligned with the opening portion 3A, when the fold P1 of the booklet P is brought into contact with the aligning part 2A, the crown portion 101 enters the opening portion 3A.

The staple removing device 1A has a removing part 5A configured to pull out the staple 100 from the booklet P. The removing part 5A includes a wedge plate assembly 50A, and a drive unit 51A configured to drive the wedge plate assembly 50A. The wedge plate assembly 50A includes a wedge plate 500A, and a support part 501A to which the wedge plate 500A is attached.

The wedge plate 500A is an example of the operating part, and is configured so that a dimension along the length direction of the aligning part 2A is shorter than the crown portion 101 of the staple 100. Also, the wedge plate 500A is configured to be thin on a tip end-side so that a dimension along a direction orthogonal to the first surface 21A of the housing 204 intersecting with the length direction and the width direction of the aligning part 2A can enter between the crown portion 101 of the staple 100 that stitches the booklet P and the booklet P, Also, the wedge plate 500A is configured to have a shape inclined in a direction in which the dimension along the direction orthogonal to the first surface 21A of the housing 20A becomes longer from the tip end toward a part at which the wedge plate 500A is attached to the support part 501A.

The support part 501A has a shaft 503A provided on a side on which the wedge plate 5004 is attached and a shaft 502A provided on a side opposite to the side on which the wedge plate 500A is attached. The shaft 502A and the shaft 503A protrude from both sides of the support part 501A along the length direction of the aligning part 2A.

The shaft 502A and the shaft 503A of the wedge plate assembly 50A enter long holes 22A formed in a pair of frames (not shown) provided to the housing 20A.

The drive unit 51A includes a rack gear 510A provided to the support part 501A, a gear 511A in mesh with the rack gear 510A, and a gear group (not shown) for transmitting a drive force of a motor 512A to the gear 511A.

In the staple removing device 1A, when an operation button 8A is pushed, the motor 512A rotates normally and reversely, based on a position of the wedge plate assembly 50A detected by a sensor (not shown). The motor 512A of the removing part 5A rotates, so that the drive force is transmitted to the wedge plate assembly 50A via the gear 511A and the rack gear 510A.

The wedge plate assembly 50A is configured so that as the shaft 502A and the shaft 503A move along the long holes 22A extending along the width direction of the aligning part 24, the wedge plate 500A moves along the width direction of the aligning part 2A. In a state where the booklet P is set in the guide part 4A and the fold P1 of the booklet P is in contact with the aligning part 2A, the wedge plate 500A moves along a direction intersecting with the fold P1 of the booklet P. Also, the shaft 503A is guided into the long holes 22A, so that the wedge plate assembly 50A rotates about the shaft 503A as a support point and the wedge plate 500A is moved into and out of the opening portion 3A. That is, the wedge plate 500A enters the opening portion 3A. In other words, when the fold P1 of the booklet P is brought into contact with the aligning part 2A, the wedge plate 500A enters the opening portion 3A into which the crown portion 101 of the staple 100 that stitches the booklet P is introduced.

The removing part 5A is configured to reciprocally move between a standby position in which the wedge plate 500A is positioned on a back surface-side of the first surface 21A below the second guide part 42A and retreats from the opening portion 3A and an operation position in which the wedge plate 500A passes through the opening portion 3A and is positioned below the first guide part 41A.

Thereby, the wedge plate 500A of the removing part 5A functions as an operating part that moves in a direction in which it comes close to the crown portion 101, which enters the opening portion 3A, from the standby position along the direction intersecting with the fold P1 of the booklet P and enters between the crown portion 101 and the booklet P to engage with the crown portion 101 and to apply a force to the staple 100 in a direction of pulling out the staple 100 from the booklet P.

Also, the guide part 4A has the first guide part 41A on a downstream side of the opening portion 3A (or aligning part 2A) with respect to the moving direction of the wedge plate 500A that comes close to the crown portion 101 entering the opening portion 3A from the standby position. Also, the guide part 4A has the second guide part 42A on an upstream side of the opening portion 3A (or aligning part 2A) with respect to the moving direction of the wedge plate 500A that comes close to the crown portion 101 entering the opening portion 3A from the standby position.

The staple removing device 1A includes a staple stopper 6A configured to restrict movement of the crown portion 101 while the wedge plate 500A enters between the crown portion 101 and the booklet P. The staple stopper 6A is provided on the downstream side of the opening portion 3A with respect to the moving direction of the wedge plate 500A that comes close to the crown portion 101 entering the opening portion 3A from the standby position. The staple stopper 6A is configured to be movable toward and away from the back surface of the first surface 21A by rotation about the shaft 60A as a support point, and is urged toward the back surface of the first surface 21A by a spring (not shown).

The staple removing device 1A includes a staple wastebasket 7A into which the staple 100 removed from the booklet P is introduced. The staple wastebasket 7A is provided below the opening portion 3A, and the staple 100 removed from the booklet P as a result of the operation of the removing part 5A falls into the staple wastebasket 7A by its own weight. The staple wastebasket 7A is configured to be advanced and retreated with respect to the housing 20A, so that the staple 100 can be discharged.

<Operation Example of Staple Removing Device of First Embodiment>

Figure 7A:
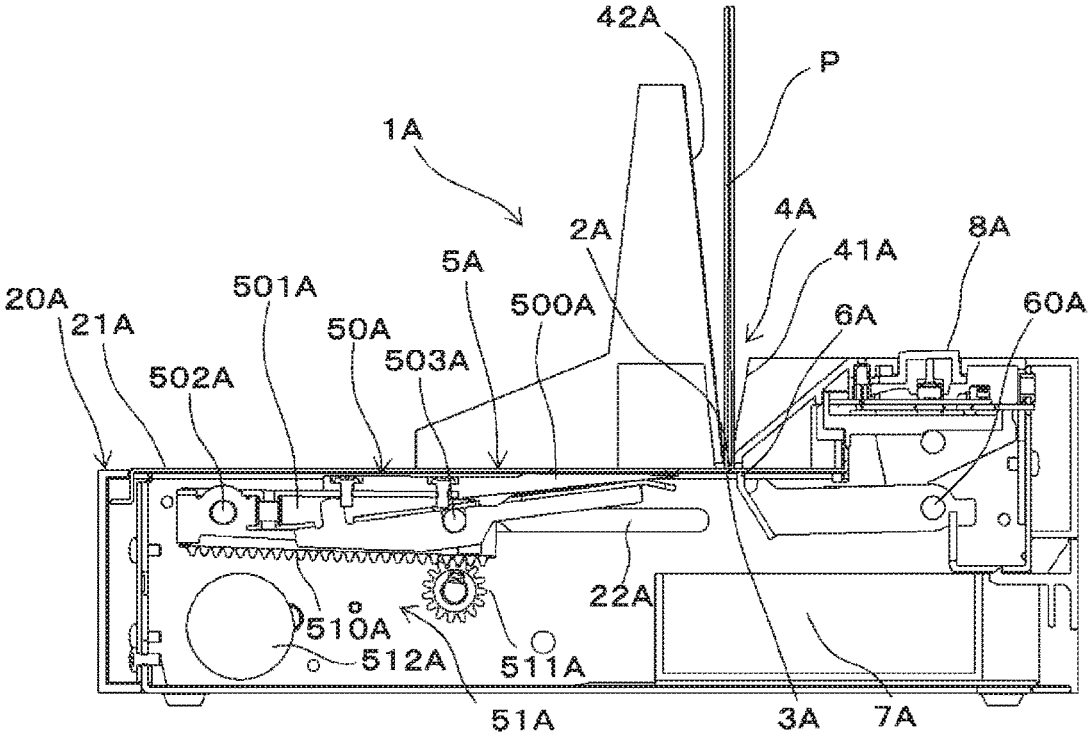
FIG. 7A is a side sectional view depicting an example of an operation of the staple removing device of the first embodiment.
Figure 7B:
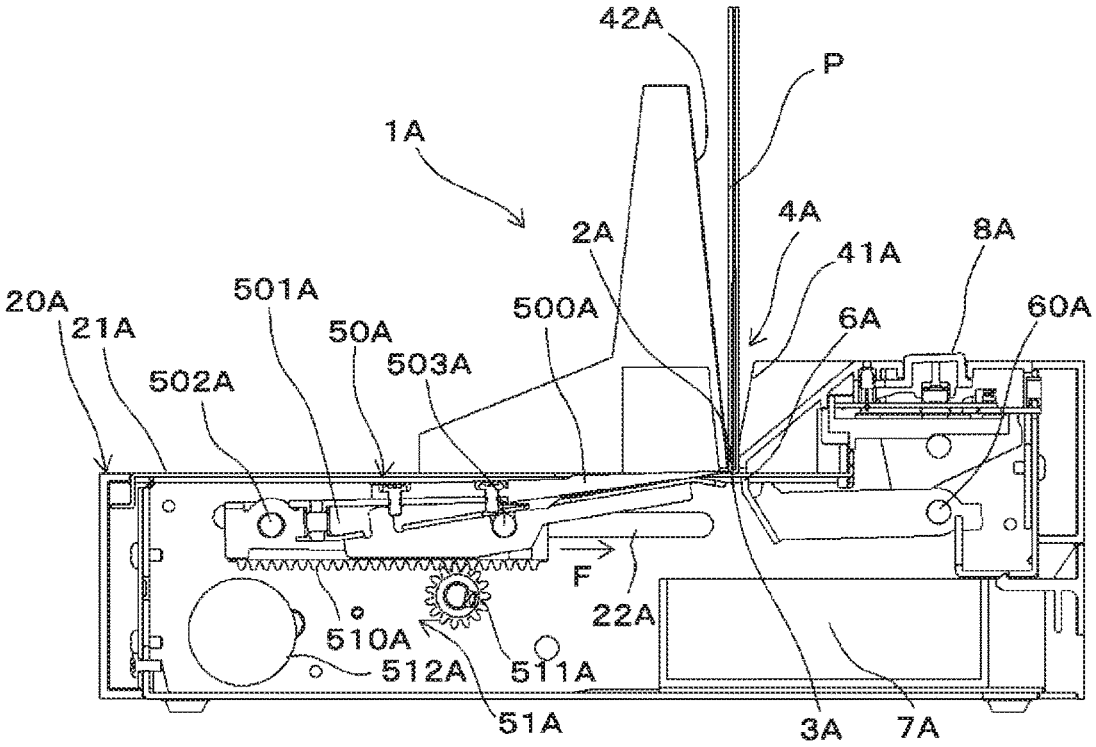
FIG. 7B is a side sectional view depicting the example of the operation of the staple removing device of the first embodiment.
Figure 7C:
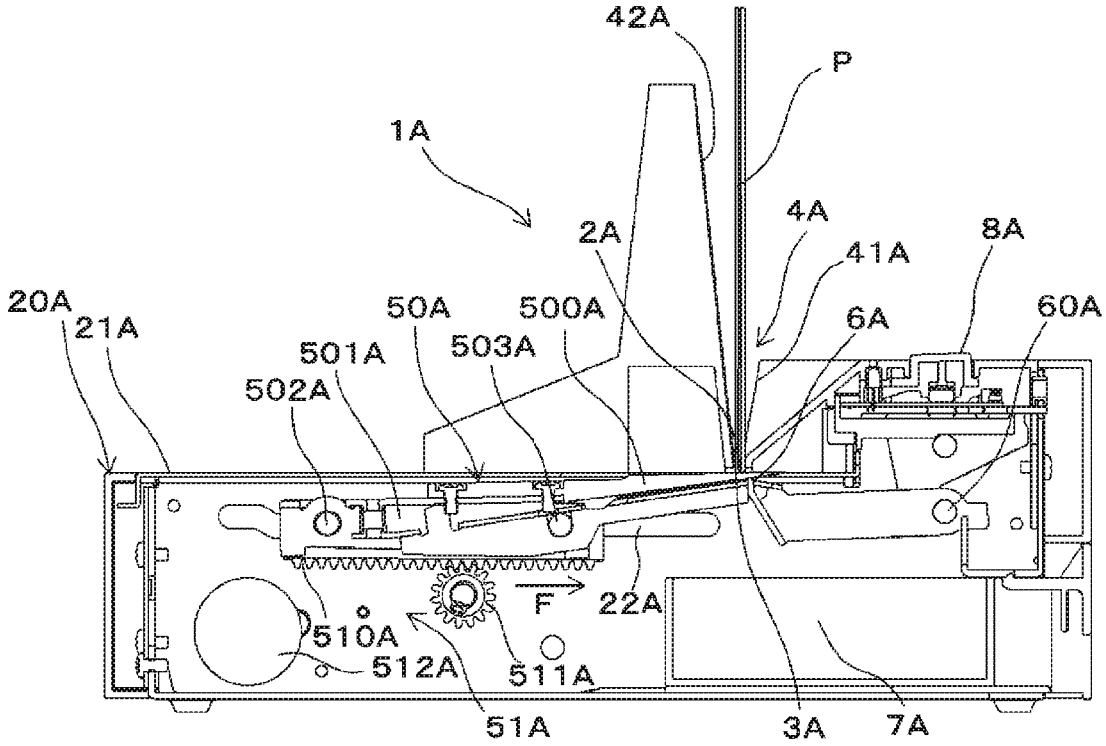
FIG. 7C is a side sectional view depicting the example of the operation of the staple removing device of the first embodiment.
Figure 7D:
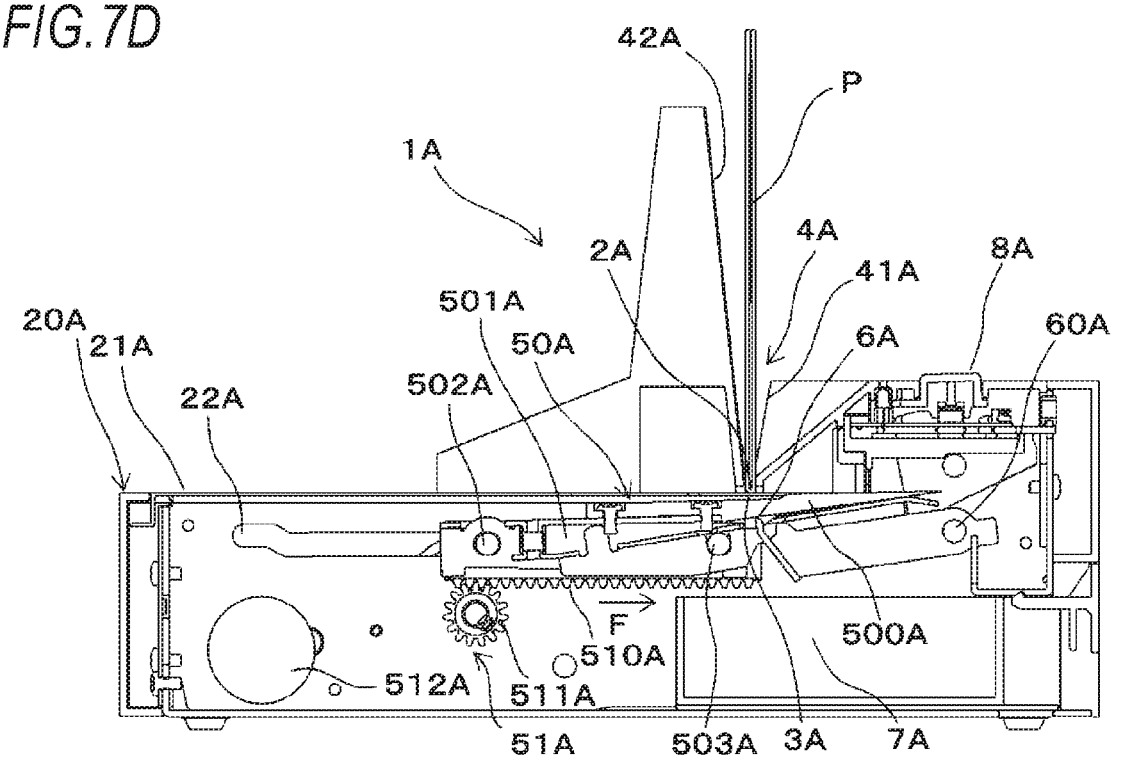
FIG. 7D is a side sectional view depicting the example of the operation of e staple removing device of the first embodiment.
Figure 8A:
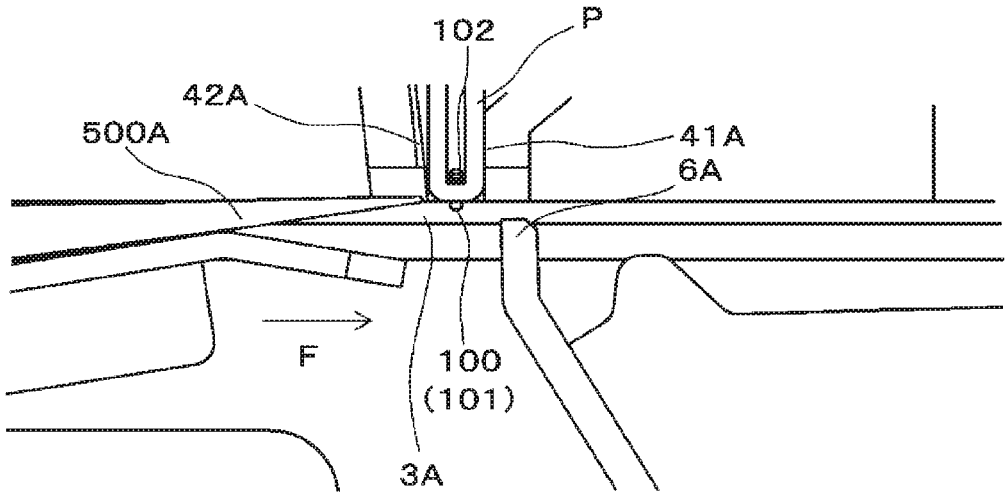
FIG. 8A is a side sectional view of main parts depicting the example of the operation of the staple removing device of the first embodiment.
Figure 8B:
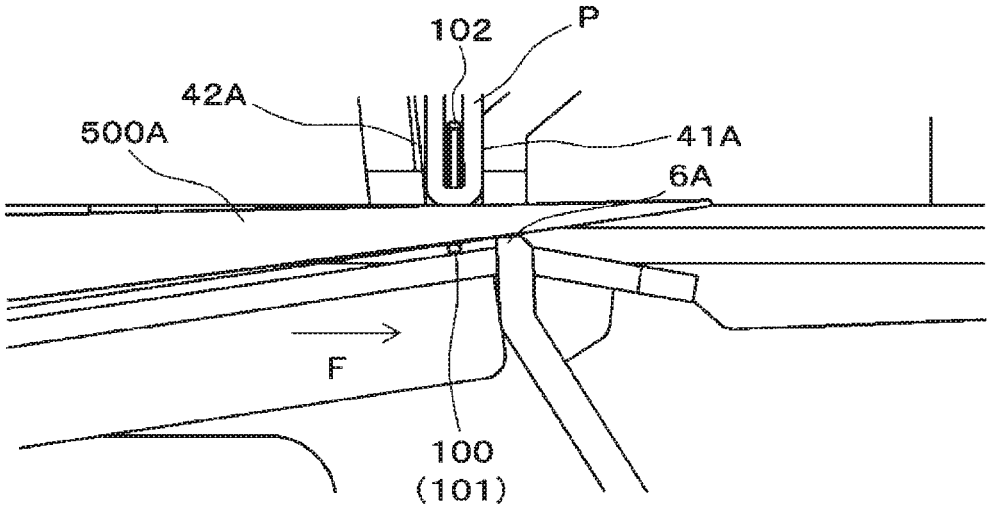
FIG. 8B is a side sectional view of the main parts depicting the example of the operation of the staple removing device of the first embodiment.

FIGS. 7A to 7D are side sectional views depicting an example of an operation of the staple removing device of the first embodiment, and FIGS. 8A and 8B are side sectional view of main parts depicting the example of the operation of the staple removing device of the first embodiment.

As shown in FIGS. 4A and 4B, in the staple removing device 1A, the closed booklet P is inserted between the first guide part 41A and the second guide part 42A configuring the guide part 4A with the fold P1 stitched by the staple 100 being directed downward.

Since the guide part 4A has such a tapered shape that the interval between the first guide part 41A and the second guide part 42A along the width direction of the aligning part 2A gradually decreases from a side distant from the aligning part 2A toward a vicinity of the part in contact with the aligning part 2A, the fold P1 is guided to the aligning part 2A by the operation of inserting the booklet P between the first guide part 414 and the second guide part 42A.

Also, the booklet P is inserted between the first guide part 41A and the second guide part 42A while aligning the crown portion 101 of the staple 100 that stitches the booklet P with the index part 43A or the index part 44A or both the index part 43A and the index part 44A.

Thereby, as shown in FIG. 7A, when the booklet P is inserted between the first guide part 414 and the second guide part 424 of the staple removing device 1A, the fold P1 of the booklet P is guided to a position in which it is in contact with the aligning part 2A with the fold P1 of the booklet P being directed toward the length direction of the aligning part 2A.

Also, the crown portion 101 of the staple 100 that stitches the booklet P is aligned with the index parts 43A and 44A, so that the position of the crown portion 101 is aligned with the opening portion 3A. In the state where the position of the crown portion 101 is aligned with the opening portion 3A, when the fold P1 of the booklet P is brought into contact with the aligning part 2A, the crown portion 101 enters the opening portion 3A.

Since the staple removing device 1A has the opening portion 3A provided between the first guide part 41A and the second guide part 42A, when the booklet P is inserted between the first guide part 41A and the second guide part 42A, it is difficult to visually recognize the position of the opening portion 3A. However, the guide part 4A is provided with the index parts 43A and 44A, so that it is possible to align the crown portion 101 of the staple 100 with the position of the opening portion 3A.

In this way, the staple removing device 1A has the guide part 4A and the guide part 4A has the index parts 43A and 44A, so that it is possible to easily set the booklet P in a predetermined position in which the staple 100 can be removed.

In the staple removing device 1A, when the operation button 8A is pushed, the motor 512A rotates normally, so that the wedge plate assembly 50A moves along the direction intersecting with the fold P1 of the booklet P, as shown in FIGS. 7B and 8B, and the wedge plate 500A moves toward the crown portion 101 entering the opening portion 3A from the standby position, as shown with an arrow F. Also, the shaft 503A is guided into the long holes 22A, so that the wedge plate assembly 50A rotates about the shaft 503A as a support point and the wedge plate 500A enters the opening portion 3A. Then, the wedge plate 500A is brought into contact with the crown portion 101 of the staple 100.

In the staple removing device 1A, when the wedge plate 500A is further moved in the direction of the arrow F in the state where the wedge plate 500A is in contact with the crown portion 101 of the staple 100, the booklet P is pushed toward the first guide part 41A.

Since the guide part 4A is configured so that the interval between the first guide part 41A and the second guide part 42A along the width direction of the aligning part 2A is substantially equal to the thickness of the booklet P in the vicinity of the part at which the booklet P is in contact with the aligning part 2A, the movements of the booklet P and the staple 100 that stitches the booklet P are restricted.

Also, the crown portion 101 of the staple 100 is in contact with the staple stopper 6A, so that the movement of the staple 100 is restricted. Thereby, as shown in FIGS. 7C and 8B, the wedge plate 5004 enters between the crown portion 101 of the staple 100 and the booklet P.

In the staple removing device 1A, as shown in FIG. 7D, when the wedge plate 500A is further moved in the direction of the arrow F in the state where the wedge plate 500A enters between the crown portion 101 of the staple 100 and the booklet P, a force is applied to the staple 100 in the direction of pulling out the staple 100 from the booklet P, so that the leg portions 102 are erected and pulled out from the booklet P. The staple 100 of which leg portions 102 are pulled out from the booklet P is dropped and accommodated into the staple wastebasket 7A by its own weight.

The staple removing device 1A detects a position of the wedge plate assembly 50A by the sensor (not shown), and when the wedge plate 500A is moved to the operation position in which the staple 100 is pulled out from the booklet P, the motor 512A rotates reversely. Thereby, the wedge plate assembly 50A moves along the direction intersecting with the fold P1 of the booklet P, and the wedge plate 500A moves from the operation position to the standby position.

By the above operation, the staple removing device 1A can set the closed booklet P bound in the two-fold bookbinding manner and remove the staple 100, without opening the booklet. Ina state where the booklet P is opened, a distance between the staple 100 and an end portion of the booklet P becomes long. Considering a configuration of a staple removing device capable of aligning a position of the staple 100 with the opening portion 3A and removing the staple 100 in a state where the booklet P is opened, it is necessary to secure a space in which the opened booklet P can be placed, which enlarges the device.

In contrast, the staple removing device 1A is provided with the guide part 4A, and the closed booklet P is set in the aligning part 2A having the opening portion 3A that the crown portion 101 enters, in the intersection direction, so that it is possible to suppress the device from being enlarged.

Note that, the second guide part 42A may be detached from the first surface 21A, and the first surface 21A may be configured as a placement for a sheet bundle. Thereby, the staple removing device 1A may also be used as a device for removing a staple from a sheet bundle where end portions of sheets are stitched by staples. In this case, a configuration for restricting movement of the sheet bundle by pressing the sheet bundle in a sheet plane direction may be added, instead of the first guide part 41A.

<Configuration Example of Staple Removing Device of Second Embodiment>

Figure 9A:
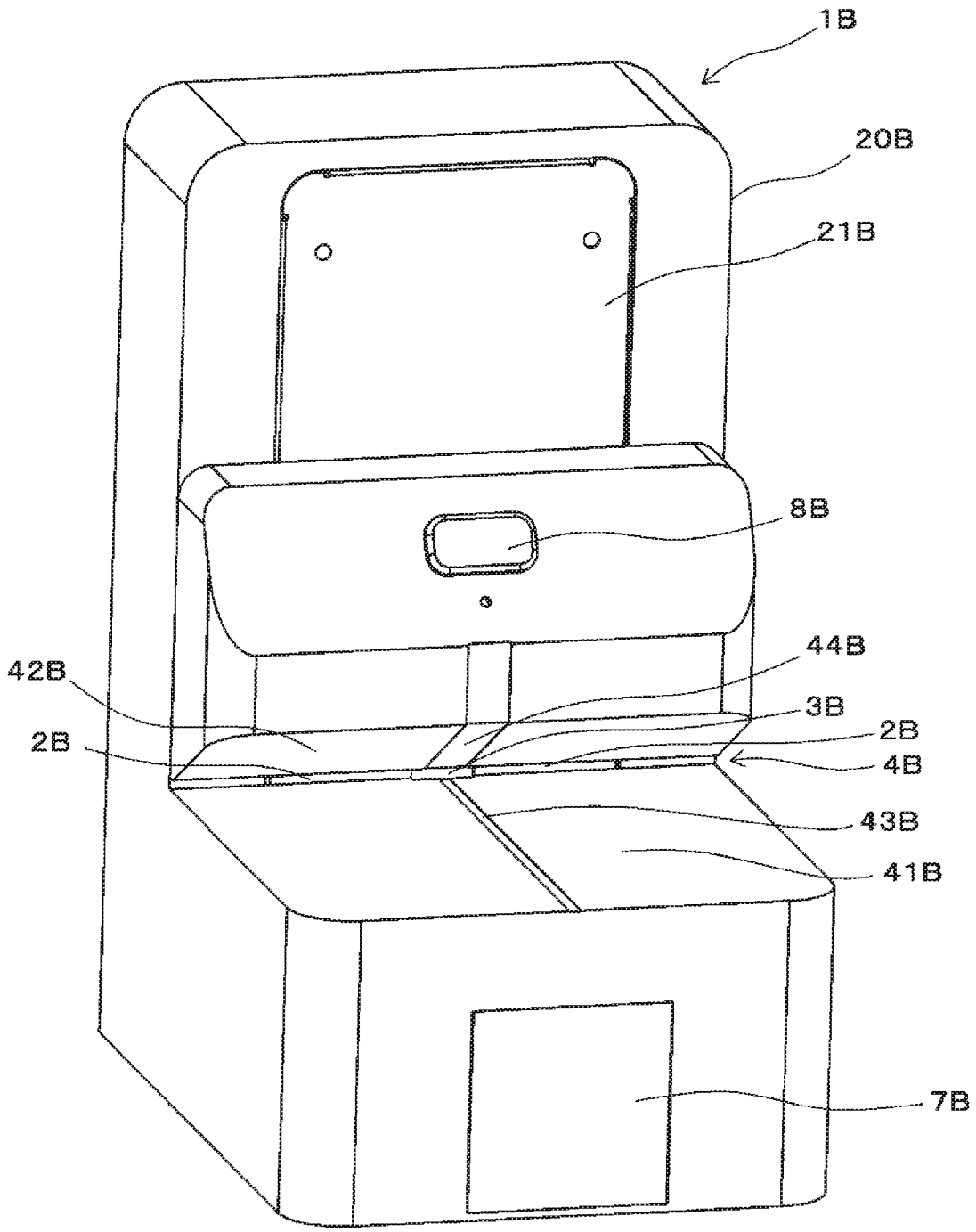
FIG. 9A is a perspective view depicting an example of a staple removing device of a second embodiment.
Figure 9B:
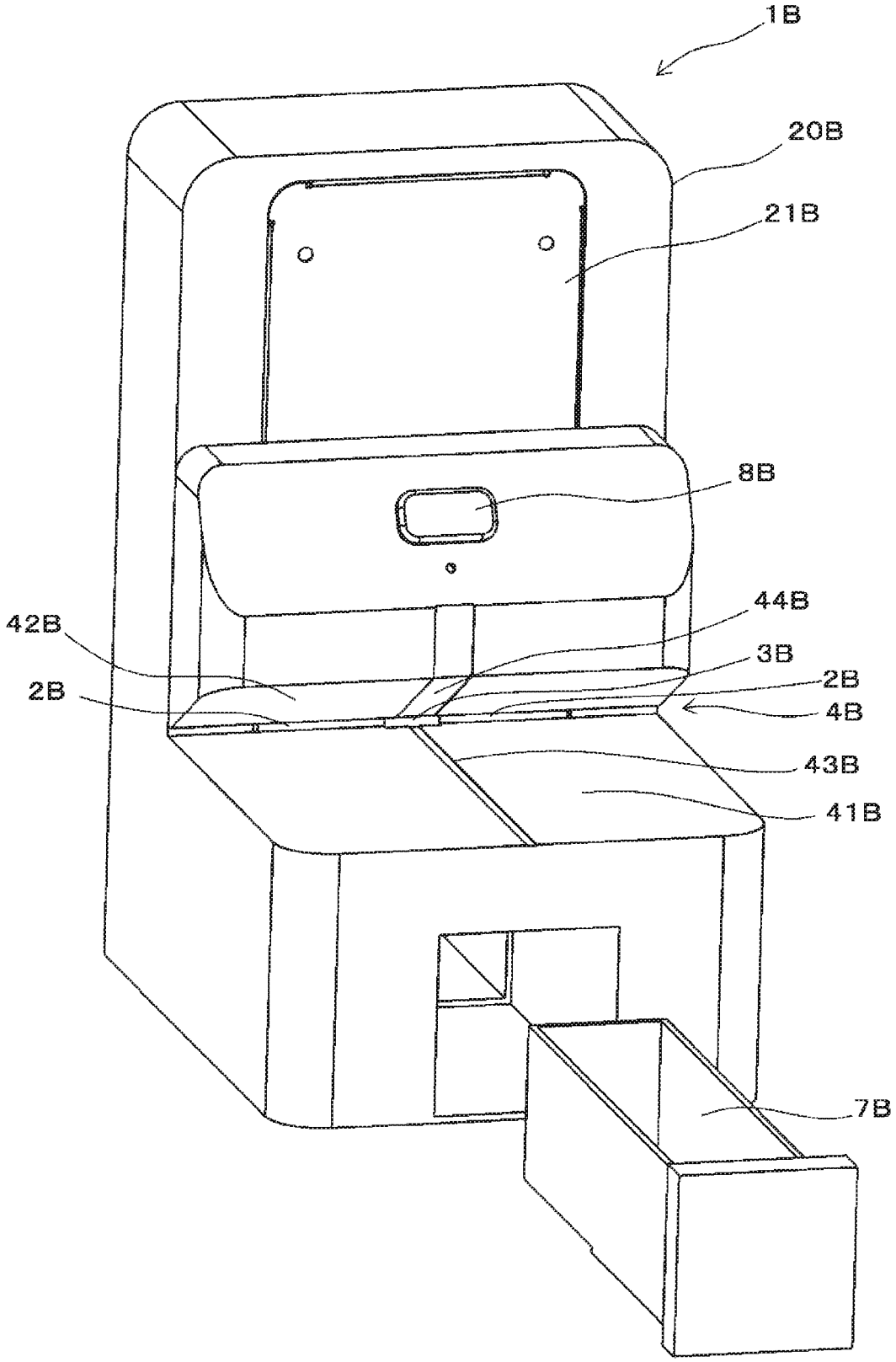
FIG. 9B is a perspective view depicting the example of the staple removing device of the second embodiment.
Figure 9C:
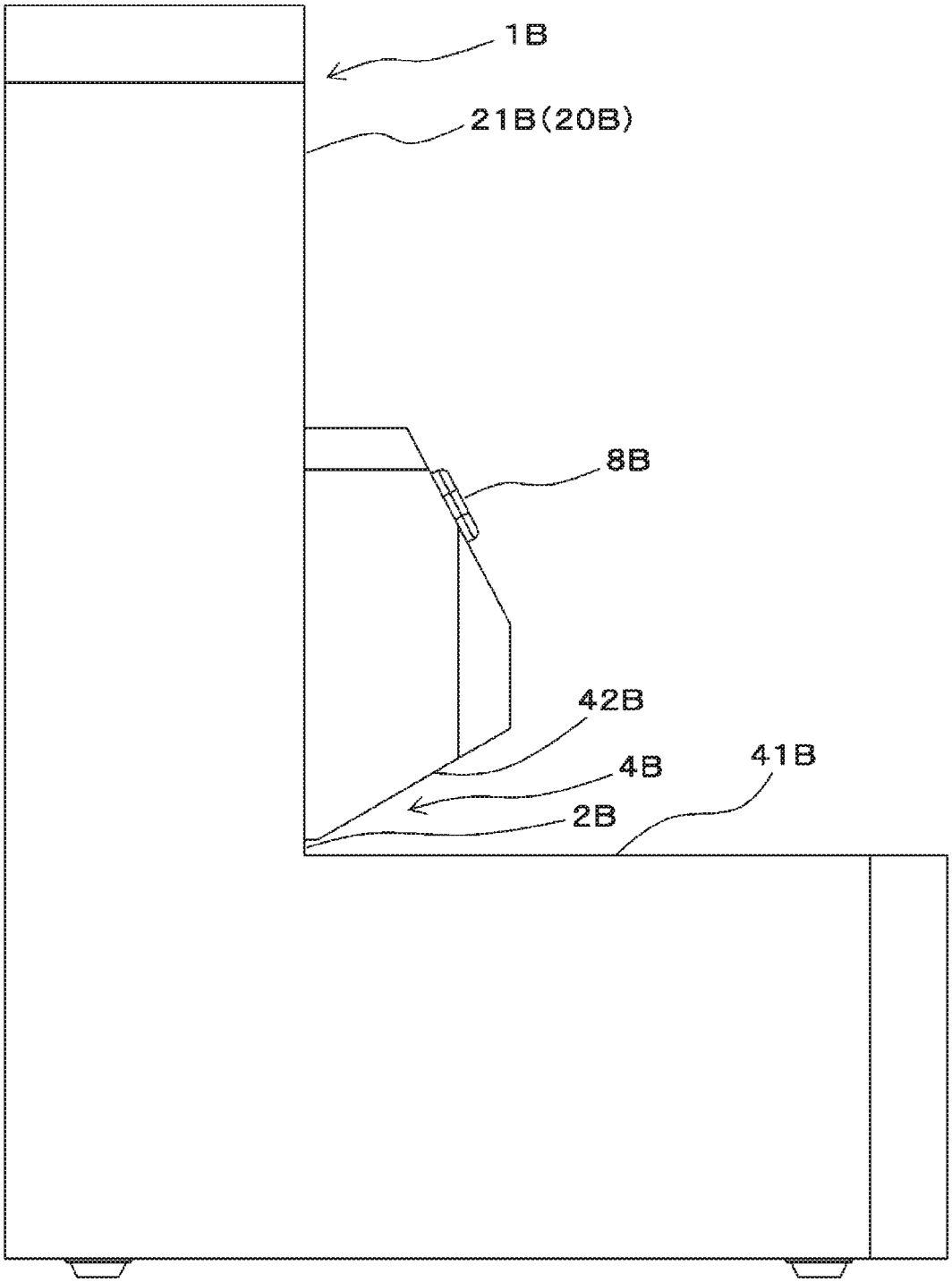
FIG. 9C is a side view depicting the example of the staple removing device of the second embodiment.
Figure 9D:
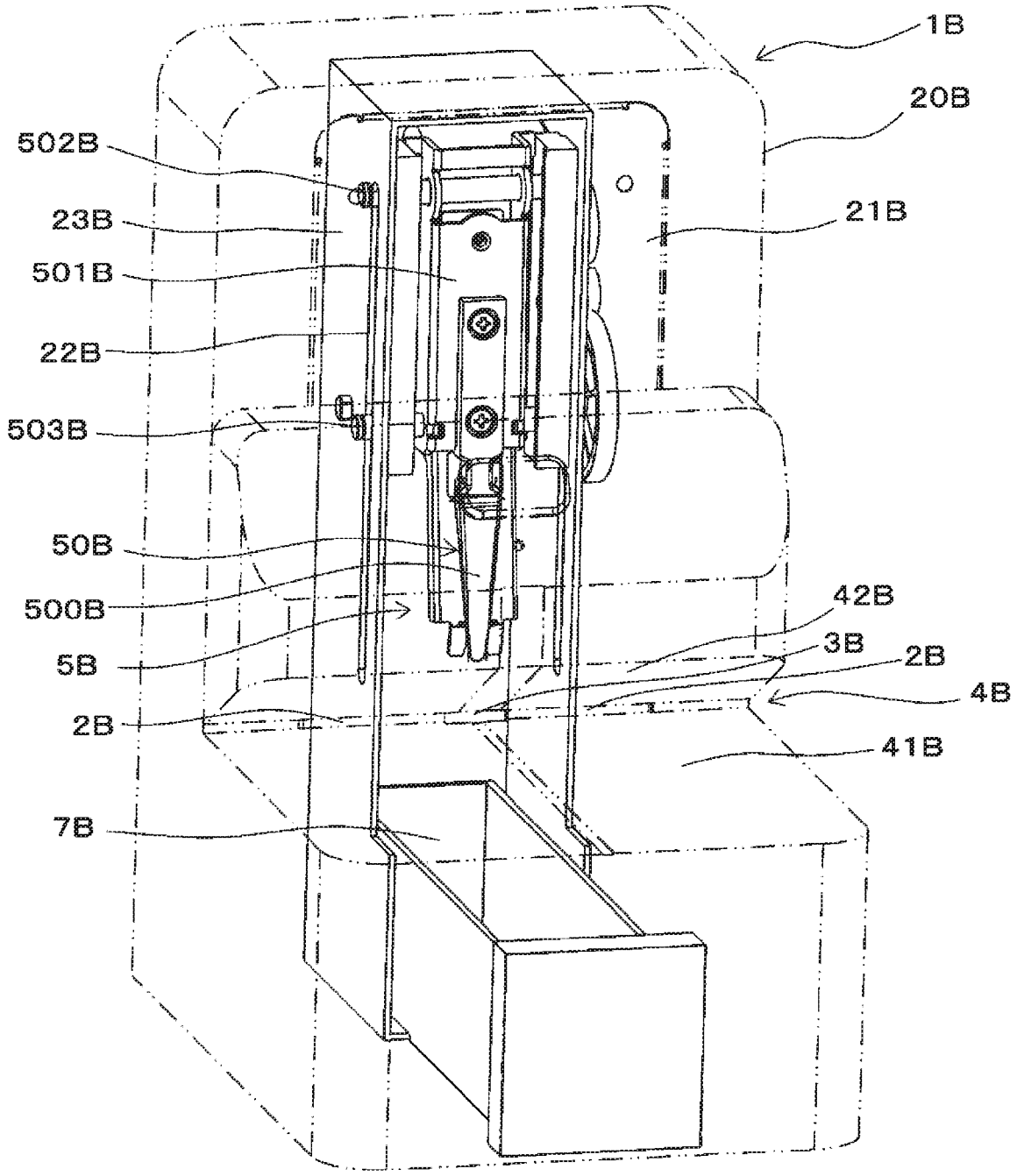
FIG. 9D is a perspective view depicting an example of an internal configuration of the staple removing device of the second embodiment.

FIGS. 9A and 9B are perspective view depicting an example of a staple removing device of a second embodiment, FIG. 9C is a side view depicting the example of the staple removing device of the second embodiment, and FIG. 9D is a perspective view depicting an example of an internal configuration of the staple removing device of the second embodiment. Also, FIG. 10A is a perspective view depicting a state where a booklet is set to the example of the staple removing device of the second embodiment, and FIG. 10B is a perspective view depicting the internal configuration in the state where the booklet is set to the example of the staple removing device of the second embodiment.

Figure 10A:
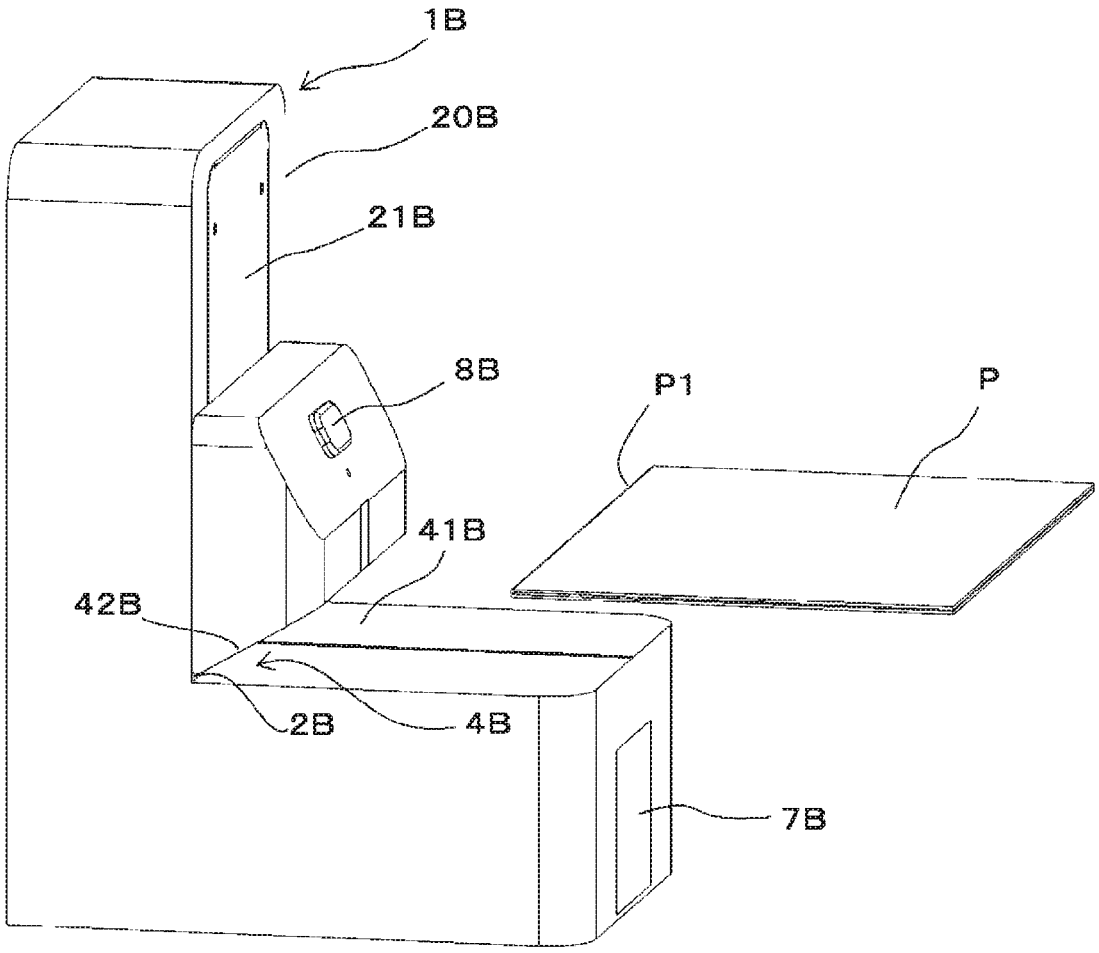
FIG. 10A is a perspective view depicting a state where a booklet is set to the example of the staple removing device of the second embodiment.
Figure 10B:
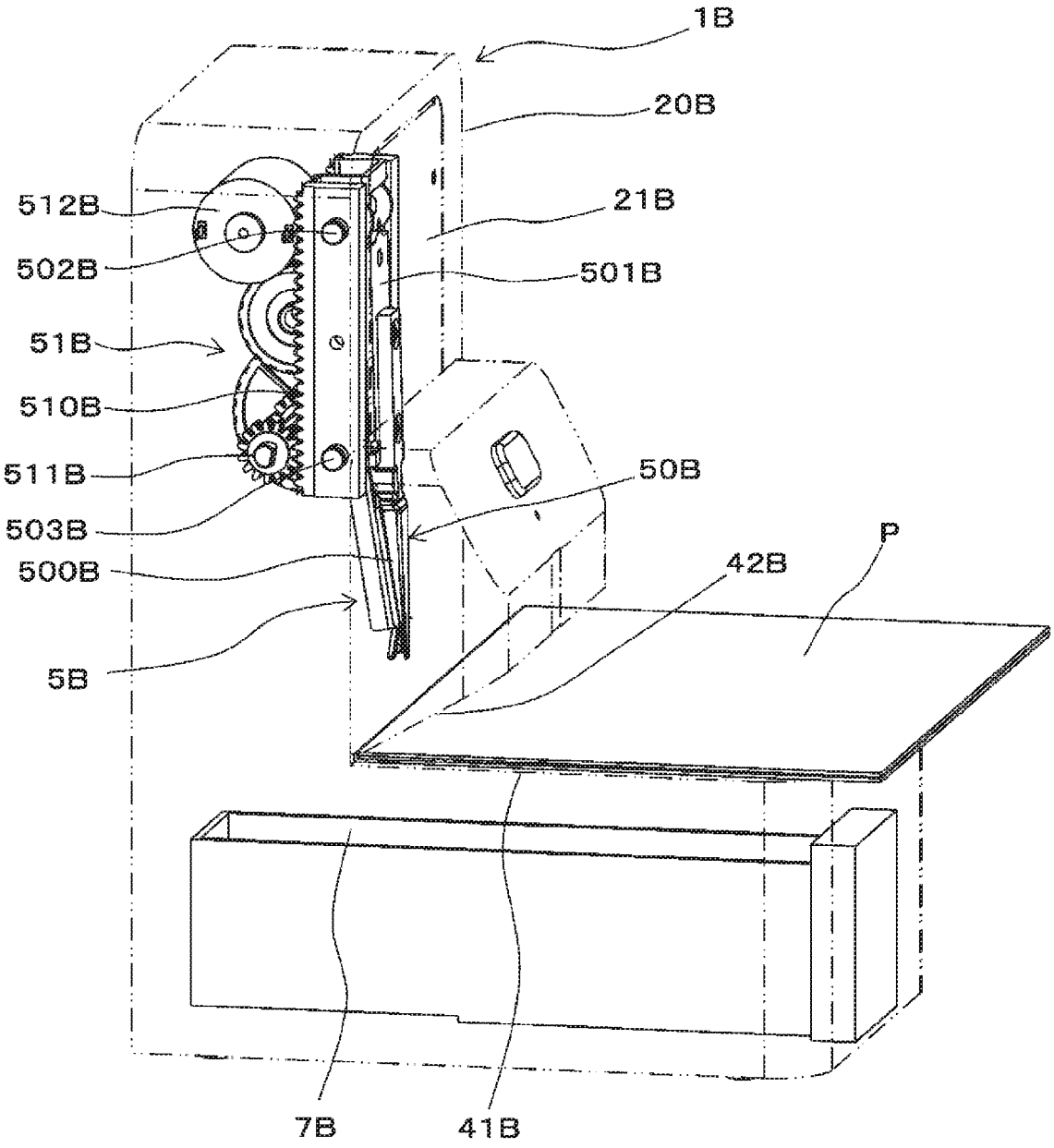
FIG. 10B is a perspective view depicting the internal configuration in the state where the booklet is set to the example of the staple removing device of the second embodiment.

As shown in FIGS. 10A and 10B, a staple removing device 1B of the second embodiment has such a configuration that the booklet P is set in a horizontal direction. The staple removing device 1B has an aligning part 2B with which the fold P1 of the booklet P is brought into contact, an opening portion 3B that the crown portion 101 of the staple 100 that stitches the booklet P enters when the fold P1 of the booklet P is brought into contact with the aligning parts 2B, and a guide part 4B configured to guide the fold P1 of the booklet P to the aligning parts 2B.

The aligning part 2B is configured by a plane having such a shape that a length along the fold P1 of the booklet Pin contact with the aligning part 2B is longer than a length along the thickness direction of the booklet P, and is provided on bath sides of the opening portion 3B along the length direction, similar to the aligning part 2A. In the present example, the aligning part 2B is configured by a first surface 21B of a housing 20B that configures an exterior of the staple removing device 1B. The staple removing device 1B of the second embodiment is placed so that the first surface 21B is vertical.

The opening portion 3B is configured by providing the aligning part 2B with an opening whose dimension along the length direction of the aligning part 2B is greater than a length in the length direction of the crown portion 101 of the staple 100 shown in FIG. 5 and the like, and a dimension along the width direction of the aligning part 2B is greater than a length in the width direction of the crown portion 101.

The guide part 4B has a first guide part 41B and a second guide part 42B protruding in directions substantially intersecting with the length direction and the width direction of the aligning part 2B. The first guide part 41B and the second guide part 42B face each other in the width direction of the aligning part 2B with the opening portion 3B being interposed therebetween.

The guide part 4B is configured so that an interval between the first guide part 41B and the second guide part 42B along the width direction of the aligning part 2B is substantially equal to the thickness of the booklet P in the vicinity of a part at which the booklet P is in contact with the aligning part 2B. Also, the first guide part 419 extends in the horizontal direction and a surface of the second guide part 42B facing the first guide part 41B is formed as an inclined surface inclined relative to a direction orthogonal to the aligning part 2B so that the interval between the first guide part 41B and the second guide part 42B along the width direction of the aligning part 2B increases away from the aligning part 2B. Thereby, the guide part 4B has a tapered shape.

The guide part 4B has index parts 43B and 44B for aligning a position of the staple 100 that stitches the booklet P with the opening portion 3B. The index part 43B is configured by a concave portion provided on a surface of the first guide part 41B facing the second guide part 42B in conformity to the position of the opening portion 39 and extending away from the opening portion 3B. The index part 44B is configured by a concave portion provided on a surface of the second guide part 42B facing the first guide part 41B in conformity to the position of the opening portion 3B and extending away from the opening portion 3B. An unevenness shape may be formed by forming a concave portion on a surface or by forming a convex portion on a surface.

Note that, the index parts 43B and 44B may also be provided by printing a plurality of lines defining a range in which the opening portion 39 is provided, a band in conformity to the opening portion 3B, and the like. The index parts 43B and 44B may include an unevenness shape, a printed matter or a combination thereof. Also, the index part may not be provided on any of the first guide part 419 and the second guide part 42B.

The staple removing device 1B has a removing part 59 configured to pull out the staple 100 from the booklet P. The removing part 5B may have a configuration similar to the removing part 5A, and includes a wedge plate assembly 50B, and a drive unit 51B configured to drive the wedge plate assembly 50B. The wedge plate assembly 50B includes a wedge plate 500B, and a support part 501B to which the wedge plate 500B is attached.

The wedge plate 500B is an example of the operating part, and is configured so that a dimension along the length direction of the aligning part 2B is shorter than the crown portion 101 of the staple 100. Also, the wedge plate 500B is configured to be thin on a tip end-side so that a dimension along a direction orthogonal to the first surface 21B of the housing 201B intersecting with the length direction and the width direction of the aligning part 29 can enter between the crown portion 101 of the staple 100 that stitches the booklet P and the booklet P. Also, the wedge plate 500B is configured to have a shape inclined in a direction in which the dimension along the direction orthogonal to the first surface 21B of the housing 20B becomes longer from the tip end toward a part that is attached to the wedge plate 500B.

The support part 501B has a shaft 503B provided on a side on which the wedge plate 5003 is attached and a shaft 502B provided on a side opposite to the side on which the wedge plate 500B is attached. The shaft 502B and the shaft 503B protrude from both sides of the support part 501B along the length direction of the aligning part 2B.

The shaft 502B and the shaft 503B of the wedge plate assembly 50B enter long holes 22B formed in a pair of frames 23B provided to the housing 20B.

The drive unit 51B includes a rack gear 510B provided to the support part 501B, a gear 511B in mesh with the rack gear 510B, and a gear group (not shown) for transmitting a drive force of a motor 512B to the gear 511B.

In the staple removing device 1B, when an operation button 8B is pushed, the motor 512B rotates normally and reversely, based on a position of the wedge plate assembly 50B detected by a sensor (not shown). The motor 512B of the removing part 5B rotates, so that the drive force is transmitted to the wedge plate assembly 50B via the gear 511B and the rack gear 510B.

The wedge plate assembly 50B is configured so that as the shaft 502E and the shaft 503B move along the long holes 22B extending along the width direction of the aligning part 2B, the wedge plate 500B moves along the width direction of the aligning part 2B. In a state where the booklet P is set in the guide part 4B and the fold P1 of the booklet P is in contact with the aligning part 2B, the wedge plate 500B moves along a direction intersecting with the fold P1 of the booklet P.

The removing part 5B is configured to reciprocally move between a standby position in which the wedge plate 500B is positioned on a rear side of the second guide part 42B and retreats from the opening portion 3B and an operation position in which the wedge plate 500B passes through the opening portion 3B and is positioned on a rear side of the first guide part 41B.

The staple removing device 1B includes a staple wastebasket 7B into which the staple 100 removed from the booklet P is introduced. The staple wastebasket 7B is provided below the rear side of the opening portion 3B, and the staple 100 removed from the booklet P as a result of the operation of the removing part 5B falls into the staple wastebasket 7B by its own weight. The staple wastebasket 7B is configured to be advanced and retreated with respect to the housing 20B, so that the staple 100 can be discharged.

As shown in FIG. 10B, in the staple removing device 1B, the closed booklet P is put on the first guide part 41B configuring the guide part 4B and is inserted between the first guide part 41B and the second guide part 42B with the fold P1 stitched by the staple 100 being directed laterally.

Since the guide part 4B has such a tapered shape that the interval between the first guide part 41B and the second guide part 42B along the width direction of the aligning part 2B gradually decreases from a side distant from the aligning part 2B toward a vicinity of the part in contact with the aligning part 2B, the fold P1 is guided to the aligning part 2B by the operation of putting the booklet P on the first guide part 41B and inserting the booklet P between the first guide part 41A and the second guide part 42A.

Also, the booklet P is inserted between the first guide part 41B and the second guide part 42B while aligning the crown portion 101 of the staple 100 that stitches the booklet P with the index part 43 or the index part 44B or both the index part 43B and the index part 44.

Thereby, when the booklet P is inserted between the first guide part 41B and the second guide part 42B of the staple removing device 1B, the fold P1 of the booklet P is guided to a position in which it is in contact with the aligning part 2B with the fold P1 of the booklet P being directed along the length direction of the aligning part 2B.

Also, the crown portion 101 of the staple 100 that stitches the booklet P is aligned with the index parts 43B and 44B, so that the position of the crown portion 101 is aligned with the opening portion 3B. In the state where the position of the crown portion 101 is aligned with the opening portion 3B, when the fold P1 of the booklet P is brought into contact with the aligning part 2B, the crown portion 101 enters the opening portion 3B.

In this way, the staple removing device 1B has the guide part 4B and the guide part 4B has the index parts 43B and 44B, so that it is possible to easily set the booklet P in a predetermined position in which the staple 100 can be removed.

Note that, in the staple removing device 1, the operation of removing the staple 100 from the booklet P by the removing part 5B is similar to that in the staple removing device 1A, and the wedge plate 500B reciprocally moves in the vertical direction with respect to the booklet P, enters between the crown portion 101 of the staple 100 and the booklet P, and removes the staple 100 from the booklet P. The staple 100 removed from the booklet P falls into the staple wastebasket 7B by its own weight.

<Other Embodiments of Staple Removing Device>

The staple removing device of the present invention is not limited to the above embodiments, and includes following embodiments.

Figure 11A:
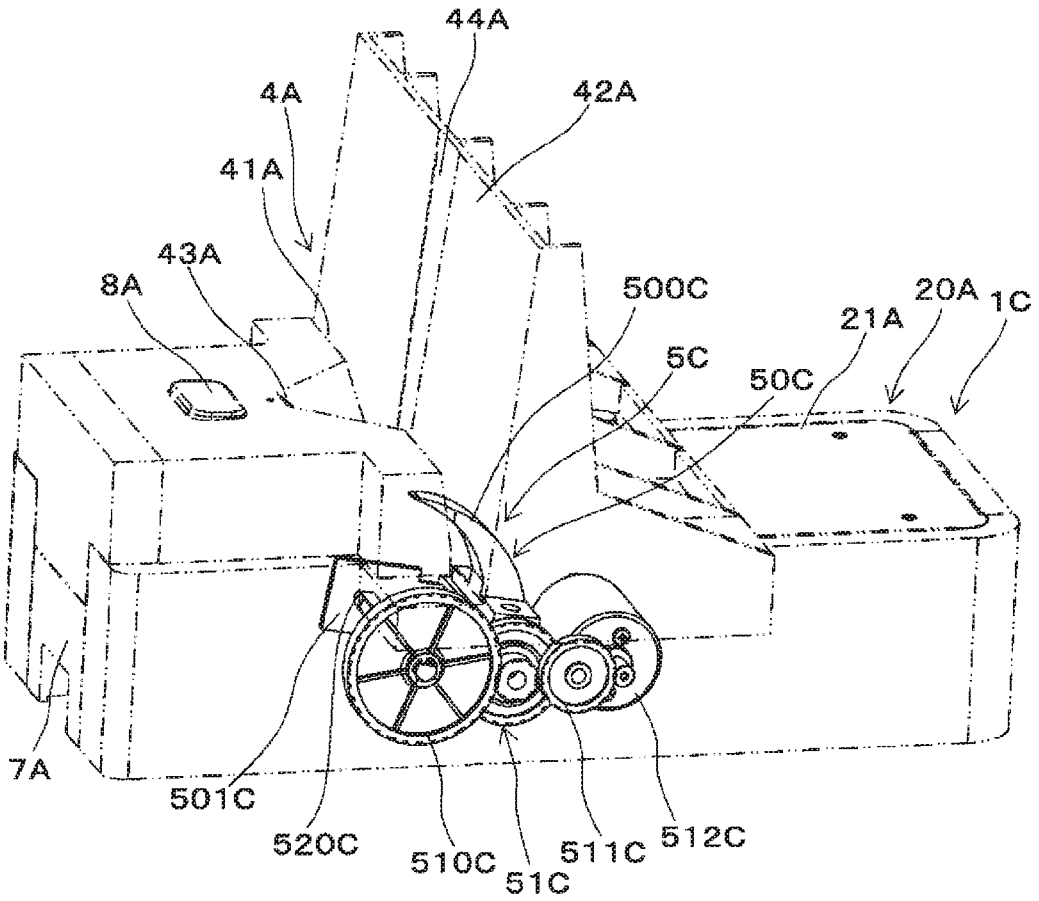
FIG. 11A is a perspective view depicting an example of a staple removing device of another embodiment (a modified embodiment of the removing part of the first embodiment).
Figure 11B:
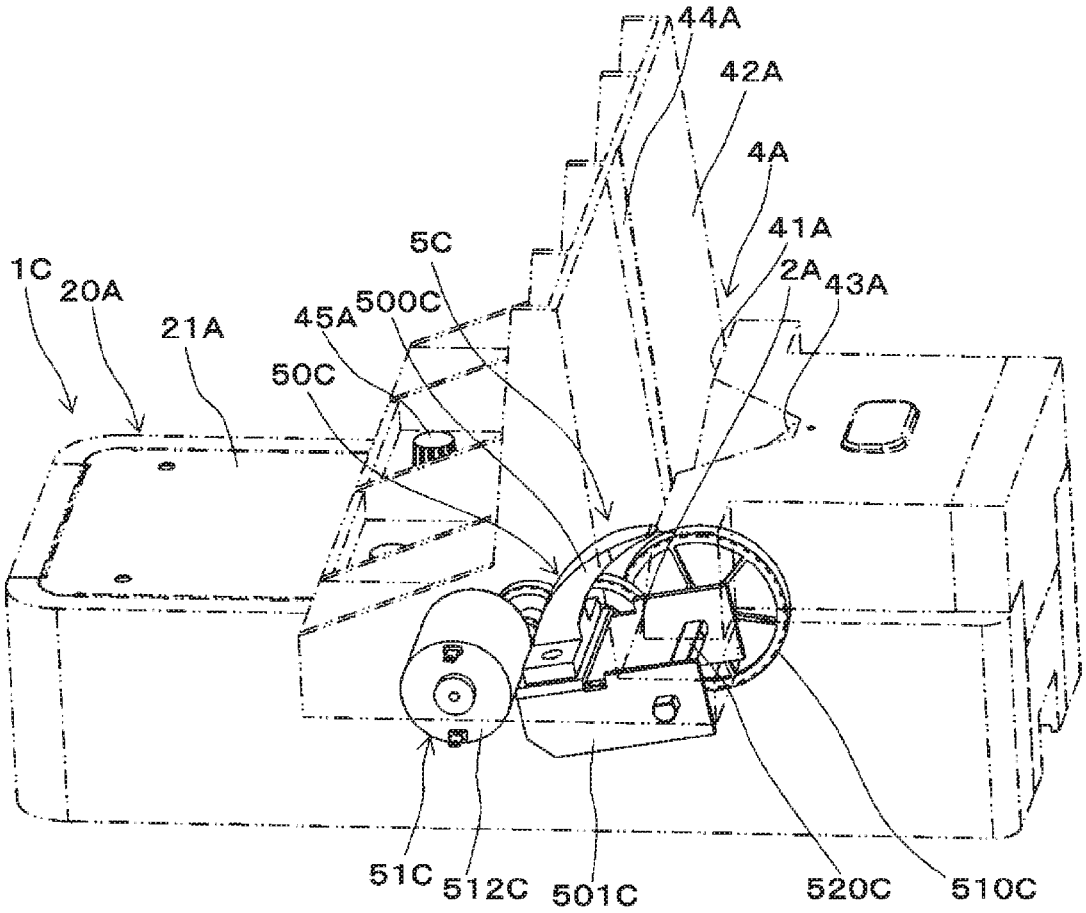
FIG. 11B is a perspective view depicting the example of the staple removing device of another embodiment (a modified embodiment of the removing part of the first embodiment).

FIGS. 11A and 11B are perspective views depicting an example of a staple removing device of another embodiment.

A staple removing device 1C of another embodiment corresponds to a modified embodiment of the removing part of the staple removing device 1A of the first embodiment. Therefore, in the staple removing device 1C, the aligning part 2A (not shown, in FIG. 11A) with which the fold P1 of the booklet P is brought into contact, the opening portion 3A (not shown, in FIGS. 11A and 11B) that the crown portion 101 of the staple 100 that stitches the booklet P enters when the fold P1 of the booklet P is brought into contact with the aligning part 2A, and the guide part 4A configured to guide the fold P1 of the booklet P to the aligning part 2A may have configurations similar to the staple removing device 1A of the first embodiment.

The staple removing device 1C includes a removing part 5C configured to pull out the staple 100 from the booklet P. The removing part 5C includes a wedge part assembly 50C, and a drive unit 51C configured to drive the wedge part assembly 50C. The wedge part assembly 50C includes a wedge part 500C, and a support part 501C to which the wedge part 500C is attached.

The support part 501C has one end portion supported to a frame (not shown) provided to the housing 20A so that it can rotate about a shaft 520C as a support point. Also, the wedge part 500C is attached to the other end portion of the support part 501C, which is displaced so as to depict a circle by a rotating operation about the shaft 520C as a support point.

The wedge part 500C is an example of the operating part, and is configured to have an arc shape along a locus of the other end portion-side of the support part 501C that is displaced to depict a circle during the rotating operation of the support part 501C about the shaft 520C as a support point. A rear end-side of the wedge part 500C, which is one end portion along a circumferential direction of the arc shape, is attached to the support part 501C.

The wedge part 500C is configured so that a dimension along the length direction of the aligning part 2A is shorter than the crown portion 101 of the staple 100. Also, the wedge part 500C is configured to be thin on a tip end-side (the other end portion along the circumferential direction of the arc shape) so that a dimension along a diametrical direction of the arc shape can enter between the crown portion 101 of the staple 100 that stitches the booklet P and the booklet P. Also, the wedge part 500C is configured to have a shape inclined in a curved shape in a direction in which the dimension along the diametrical direction of the arc shape becomes longer from the tip end toward the rear end-side that is attached to the support part 501C. Note that, the wedge part 500C may also be configured to have a shape where a dimension along the length direction of the aligning part 2A becomes wider from the tip end toward the rear end-side.

The drive unit 51C includes a gear 510C provided to the shaft 520C of the support part 501C, and a gear group 511C for transmitting a drive force of a motor 512C to the gear 510C.

In the staple removing device 1C, when the operation button 8A is pushed, the motor 512C rotates normally and reversely, based on a position of the wedge part assembly 50C detected by a sensor (not shown). The motor 512C of the removing part 5C rotates, so that the drive force is transmitted to the wedge part assembly 50C via the gear group 511C and the gear 510C.

In the wedge part assembly 50C, the support part 501C rotates about the shaft 520C as a support point, so that the wedge part 500C is displaced so as to depict an arc by a rotating operation about the shaft 520C as a support point. Thereby, the arc-shaped wedge part 500C is displaced along the circumferential direction, so that the wedge part 500C moves along the width direction of the aligning part 2A. Note that, the displacement of the wedge part 5000 by the rotating operation about the shaft 520C as a support point is referred to as 'rotation' In a state where the booklet P is set in the guide part 4A and the fold P1 of the booklet P is in contact with the aligning put 2A, the wedge part 500C moves along the direction intersecting with the fold P1 of the booklet P. Also, a locus of the tip end portion and arc-shaped outer peripheral surface of the wedge part 500C resulting from the rotation about the shaft 520C as a support point protrudes from the opening portion (not shown) toward the first surface 21A, and the tip end portion and the arc-shaped outer peripheral surface of the wedge part 500C are advanced and retreated with respect to the opening portion.

The removing part 5C is configured to reciprocally move by the rotation about the shaft 520C as a support point between a standby position in which the wedge part 500C is positioned on a back surface-side of the first surface 21A below the second guide part 42A and an operation position in which the wedge part 500C passes through the aligning part 2A and is positioned below the first guide part 41A.

Thereby, the wedge part 500C of the removing part 5C configured to rotate about the shaft 520C as a support point functions as an operating part, similar to the wedge part 500A.

Figure 12A:
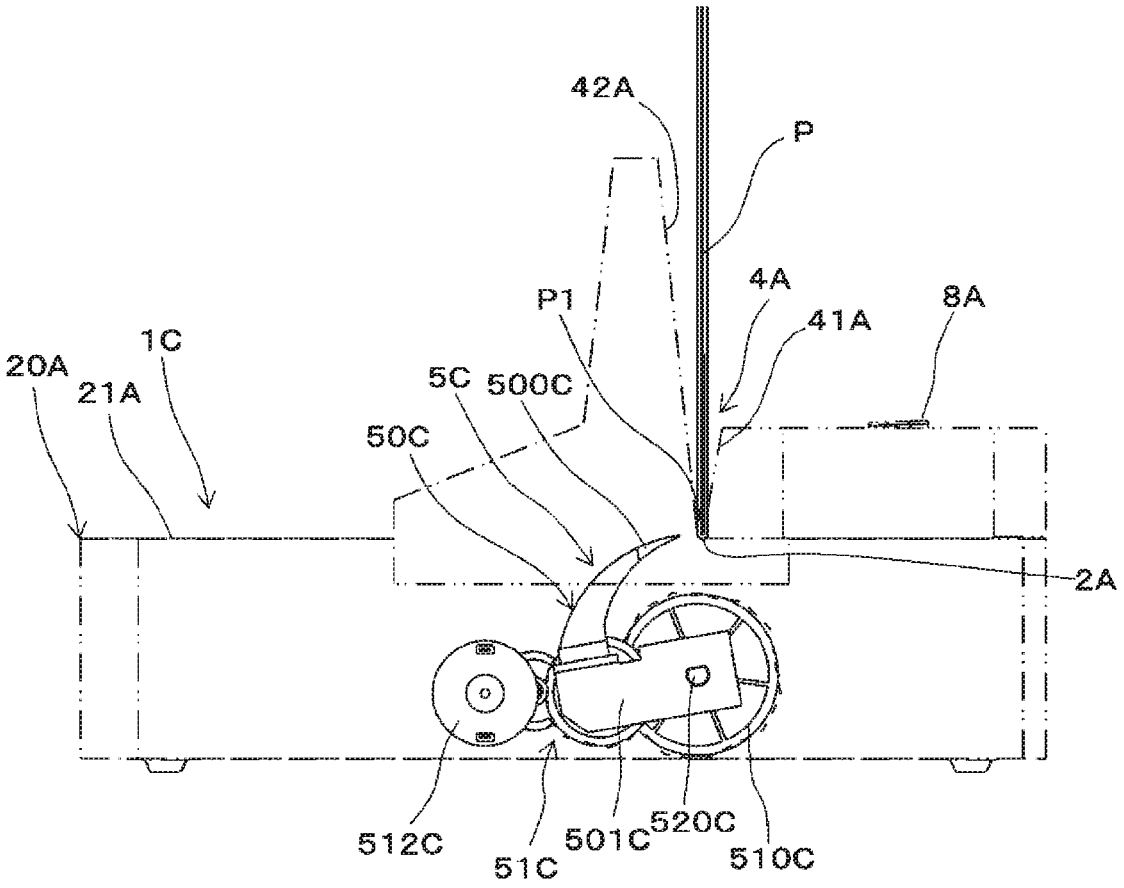
FIG. 12A is a side sectional view depicting an example of an operation of the staple removing device of another embodiment (a modified embodiment of the removing part of the first embodiment).
Figure 12B:
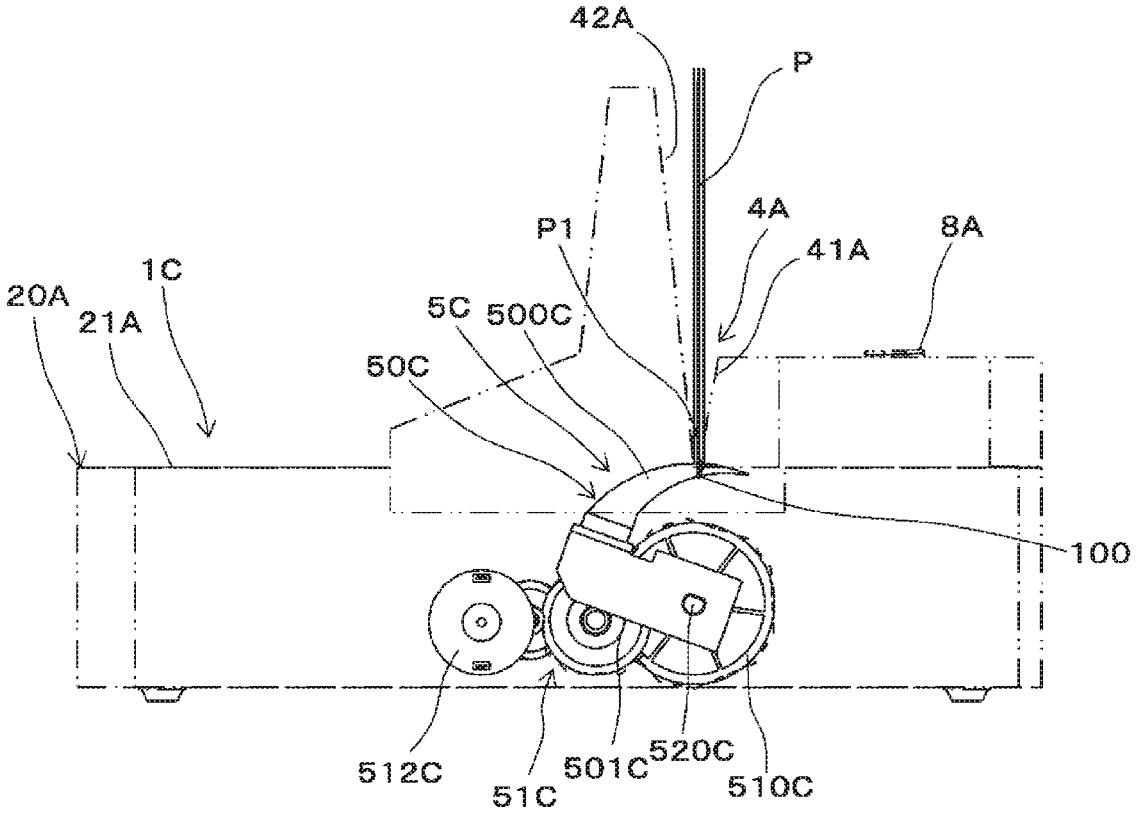
FIG. 12B is a side sectional view depicting the example of the operation of the staple removing device of another embodiment (a modified embodiment of the removing part of the first embodiment).
Figure 12C:
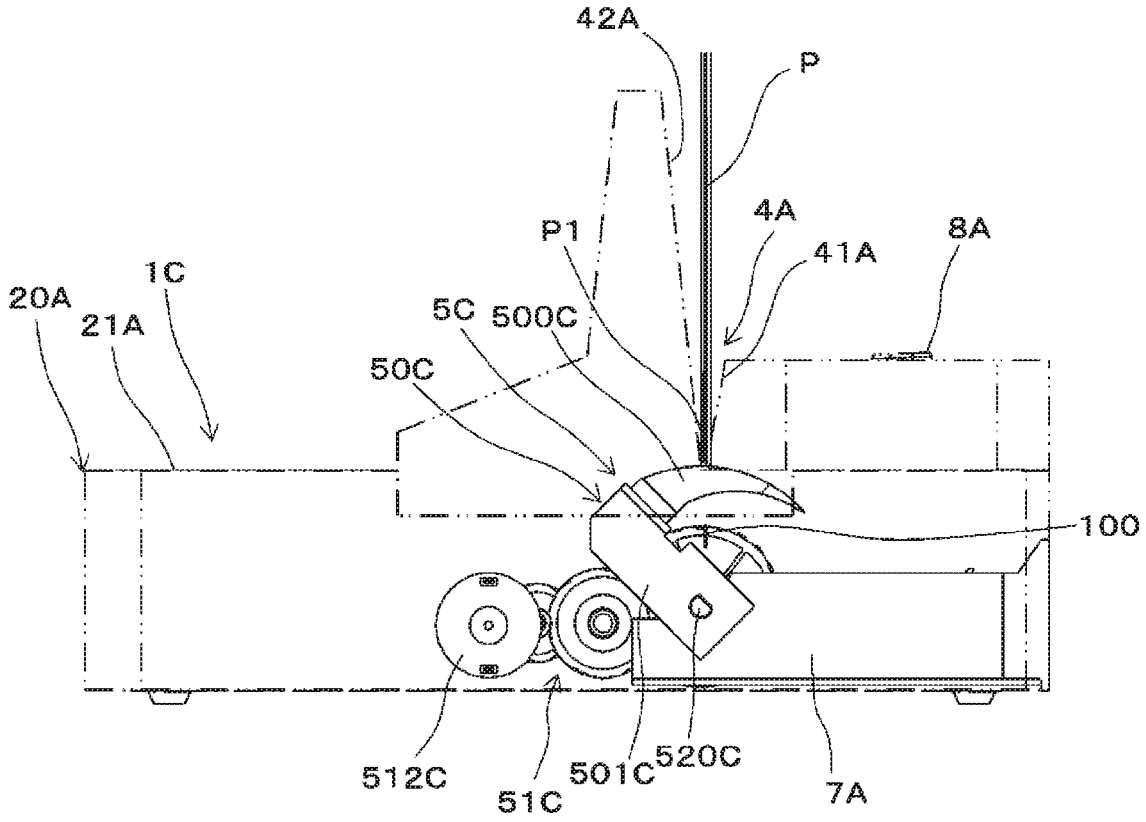
FIG. 12C is a side sectional view depicting the example of the operation of the staple removing device of another embodiment (a modified embodiment of the removing part of the first embodiment).
Figure 12D:
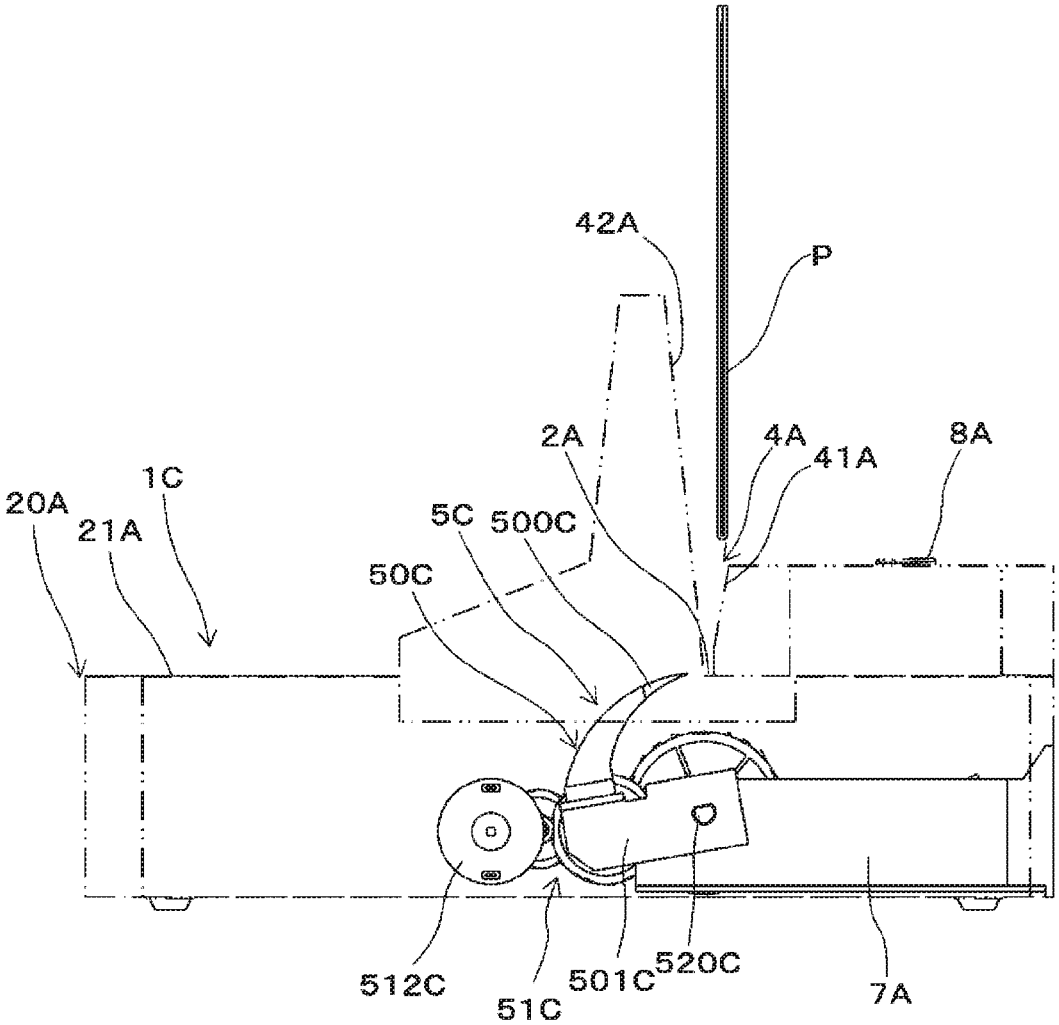
FIG. 12D is a side sectional view depicting the example of the operation of the staple removing device of another embodiment (a modified embodiment of the removing part of the first embodiment)
Figure 13A:
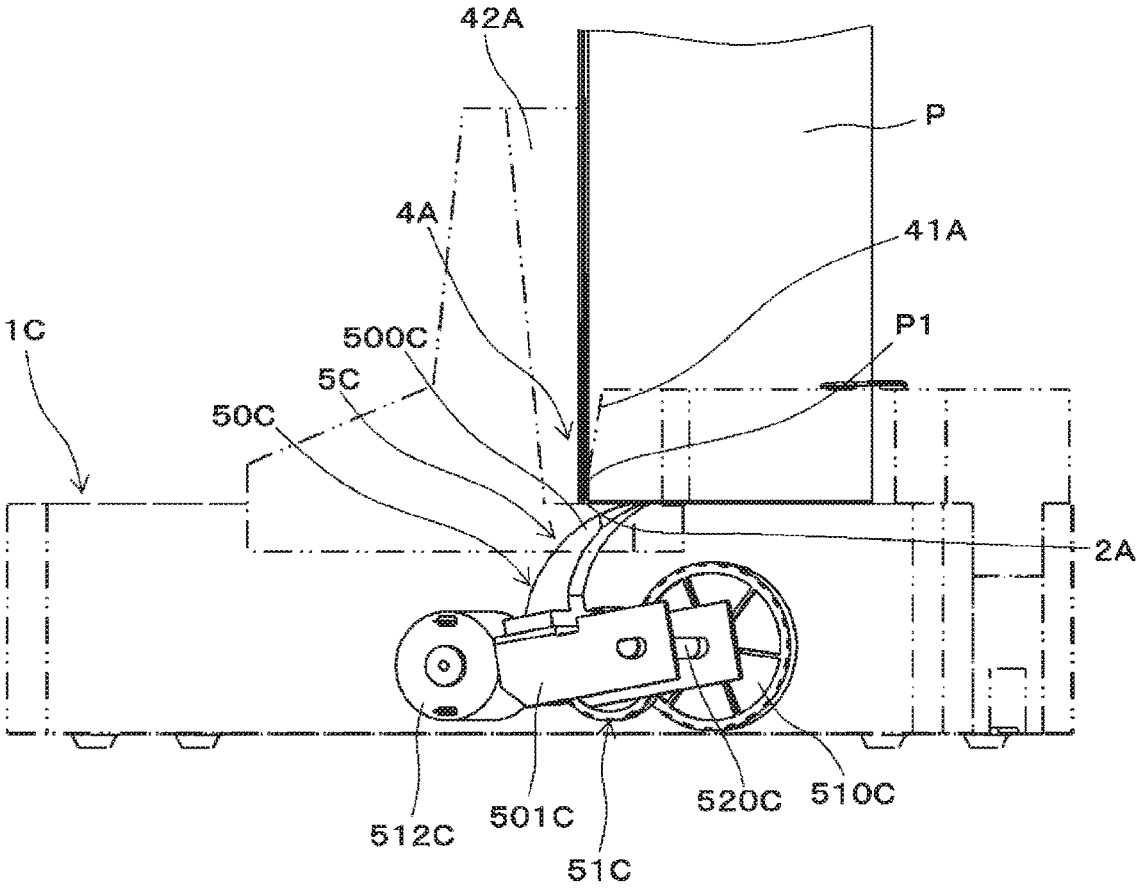
FIG. 13A is a perspective view depicting the example of the operation of the staple removing device of another embodiment (a modified embodiment of the removing part of the first embodiment).
Figure 13B:
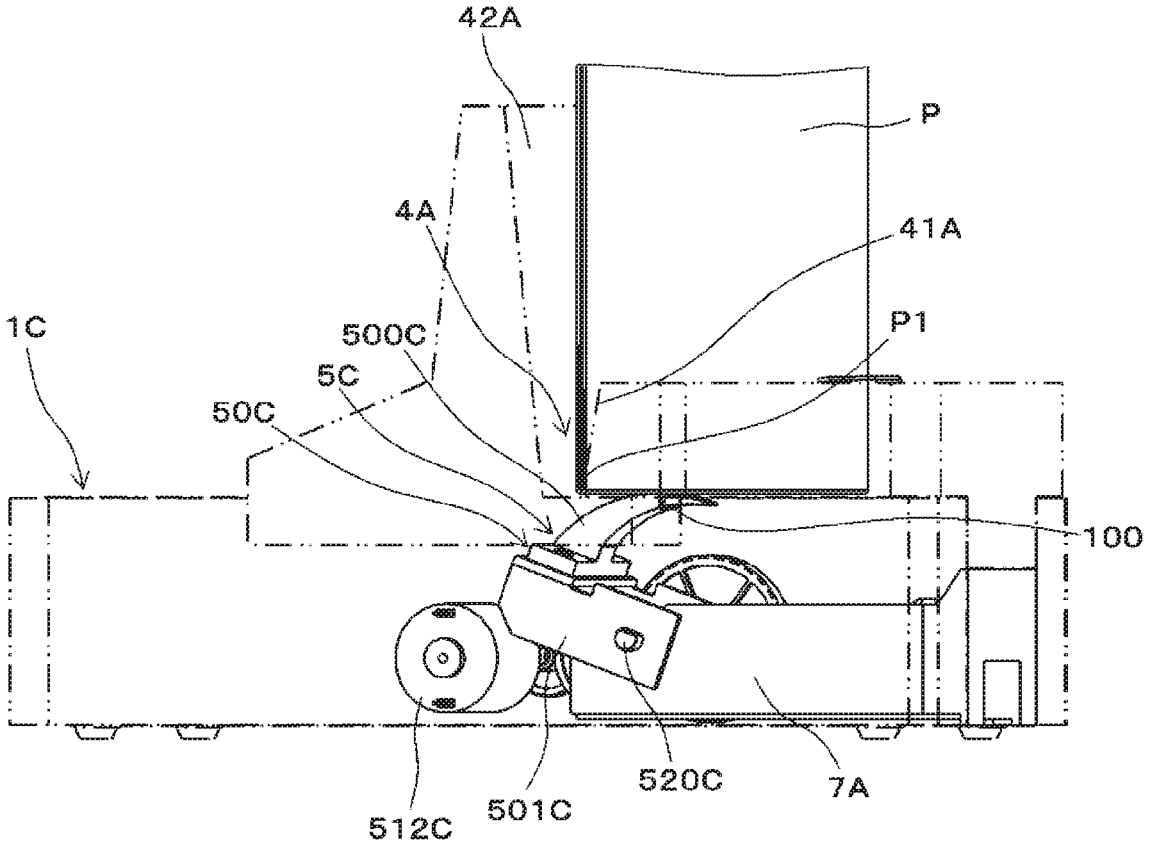
FIG. 13B is a perspective view depicting the example of the operation of the staple removing device of another embodiment (a modified embodiment of the removing part of the first embodiment).
Figure 13C:
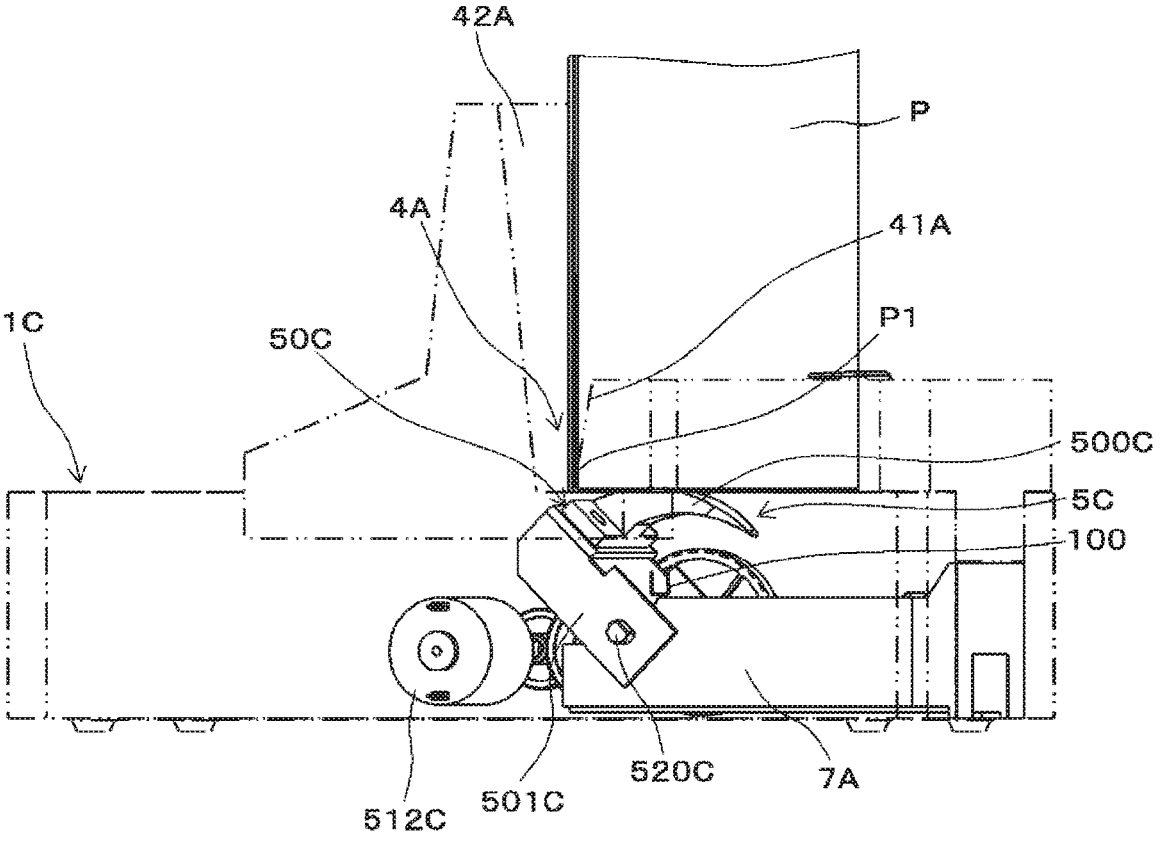
FIG. 13C is a perspective view depicting the example of the operation of the staple removing device of another embodiment (a modified embodiment of the removing part of the first embodiment).

FIGS. 12A to 12D are side sectional views depicting an example of an operation of the staple removing device of another embodiment, and FIGS. 13A to 13C are perspective views depicting the example of the operation of the staple removing device of another embodiment.

In the staple removing device 1C, the closed booklet P is inserted between the first guide part 41A and the second guide part 42A configuring the guide part 4A, while the fold P1 stitched with the staple 100 is directed downward, as shown in FIGS. 5 and 6. Note that, the operational effects of the guide part 4A are similar to the staple removing device 1A of the first embodiment.

In the staple removing device 1C, when the booklet P is inserted between the first guide part 41A and the second guide part 42A, the fold P1 of the booklet P is guided to a position in which it is in contact with the aligning part 2A, while the fold P1 of the booklet P is directed along the length direction of the aligning part 2A.

Also, when the fold P1 of the booklet P is in contact with the aligning part 2A in a state where the position of the crown portion 101 is aligned with the opening portion (not shown), the crown portion 101 enters the opening portion.

Thereby, the staple removing device 1C has the guide part 4A, so that it is possible to easily set the booklet P in the predetermined position in which the staple 100 can be removed. Also, the guide part 4A of the staple removing device 1C has the index parts 43A and 44A, so that it is possible to more easily set the booklet P in the predetermined position in which the staple 100 can be removed.

In the staple removing device 1C, when the operation button 8A is pushed, the motor 512C rotates normally, so that the wedge part assembly 50C moves along the direction intersecting with the fold P1 of the booklet P by the rotating operation of the wedge part 50C about the shaft 520C as a support point, as shown in FIGS. 12A and 13A. Thereby, the wedge part 500C moves in a direction in which a tip end portion thereof comes close to the crown portion 101 of the staple 100 that stitches the booklet P from the standby position. Then, the tip end portion of the wedge part 500C is brought into contact with the crown portion 101.

In the staple removing device 1C, when the wedge part 500C further rotates in the direction in which it moves from the standby position toward the operation position in the state where the wedge part 500C is in contact with the crown portion 101 of the staple 100, the wedge part 500C enters between the crown portion 101 of the staple 100 and the booklet P, as shown in FIGS. 12B and 13B.

As shown in FIGS. 12C and 13C, in the staple removing device 1C, when the wedge part 500C further rotates in the state where the wedge part 500C enters between the crown portion 101 of the staple 100 and the booklet P, the force of pulling out the staple 100 from the booklet P is applied to the staple 100, so that the leg portions 102 are erected and pulled out from the booklet P. The staple 100 whose leg portions 102 are pulled out from the booklet P is dropped and accommodated in the staple wastebasket 7A by its own weight.

The staple removing device 1C detects a position of the wedge part assembly 50C by the sensor (not shown), and when the wedge part 500C is moved to the operation position in which the staple 100 is pulled out from the booklet P, the motor 512C rotates reversely. Thereby, as shown in FIG. 12D, the wedge part 500C moves from the operation position to the standby position.

By the above operation, the staple removing device 1C can also set the closed booklet P bound in the two-fold bookbinding manner and remove the staple 100, without opening the booklet, similar to the staple removing device 1A.

Figure 14A:
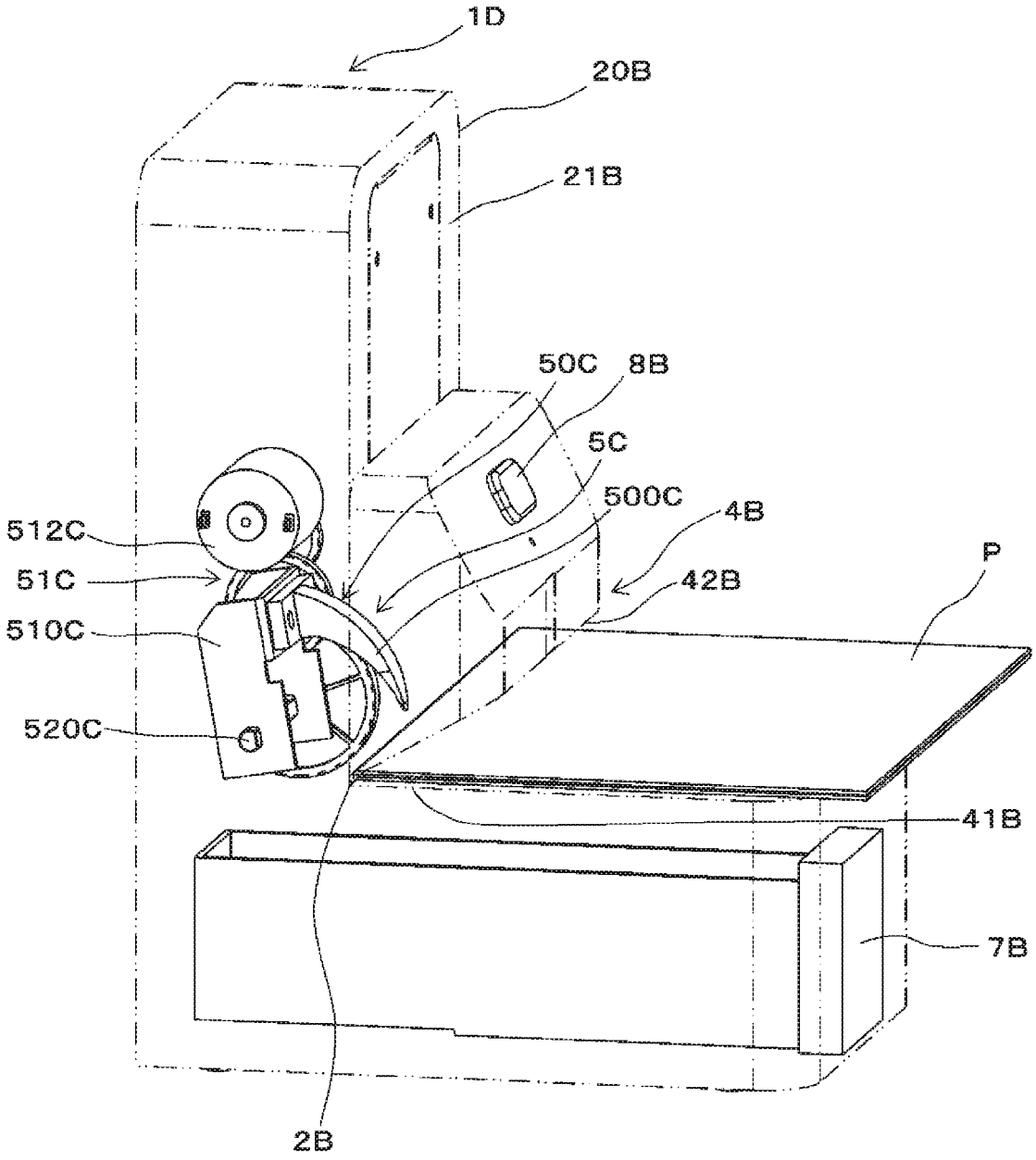
FIG. 14A is a perspective view depicting another example of the staple removing device of another embodiment (a modified embodiment of the removing part of the second embodiment).
Figure 14B:
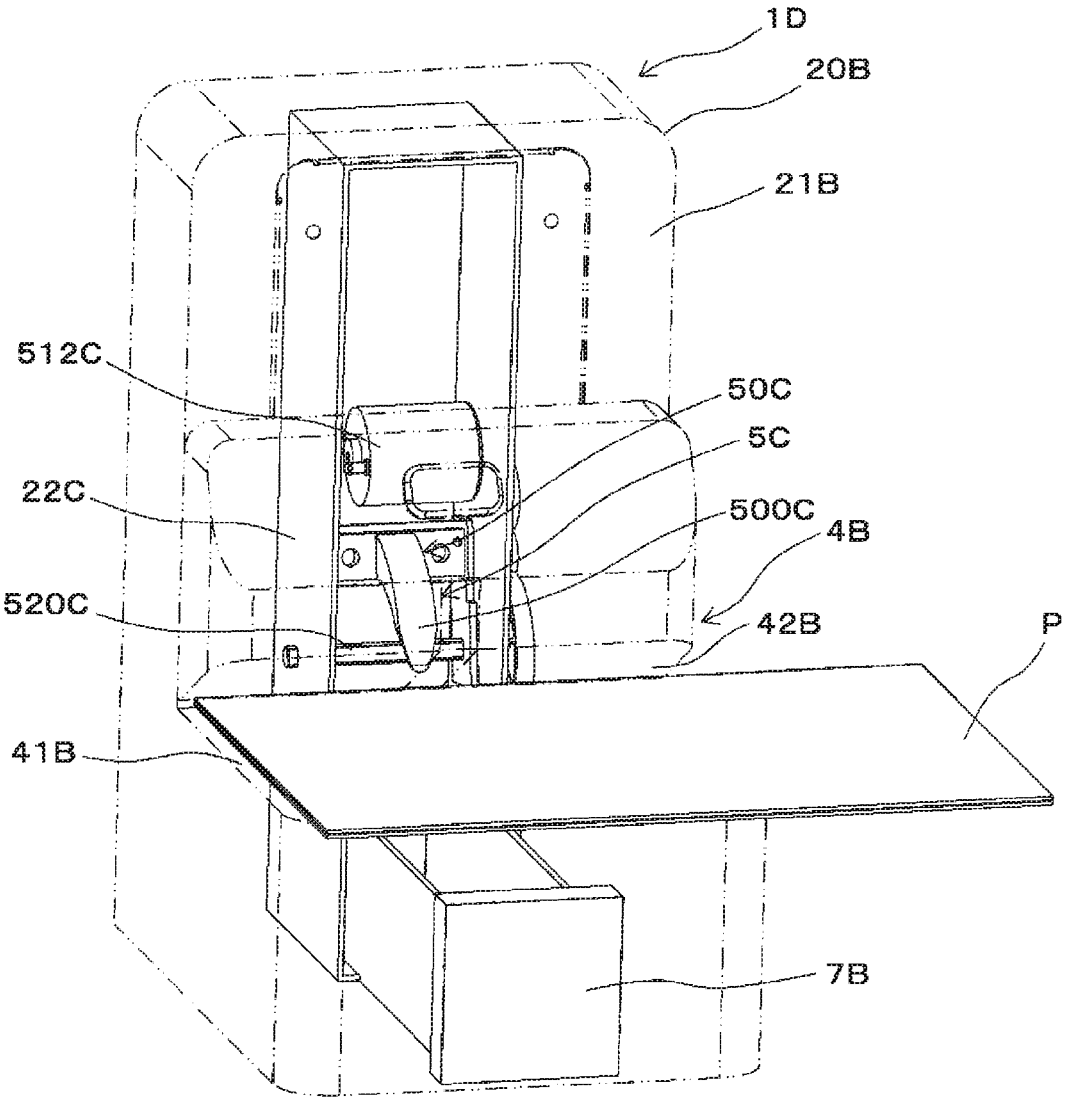
FIG. 14B is a perspective view depicting another example of the staple removing device of another embodiment (a modified embodiment of the removing part of the second embodiment).

FIGS. 14A and 14B are perspective views depicting another example of the staple removing device of another embodiment.

A staple removing device 1D of another example of another embodiment corresponds to a modified embodiment of the removing part of the staple removing device 1B of the second embodiment in which the booklet P is set in the horizontal direction. Therefore, in the staple removing device 1D, the aligning part 2B (not shown, in FIG. 14B) with which the fold P1 of the booklet P is brought into contact, the opening portion 3B (not shown, in FIGS. 14A and 14B) that the crown portion 101 of the staple 100 that stitches the booklet P enters when the fold P1 of the booklet P is brought into contact with the aligning part 2B, and the guide part 4B configured to guide the fold P1 of the booklet P to the aligning part 2B may have configurations similar to the staple removing device 1B of the second embodiment.

The staple removing device 1D includes the removing part 5C configured to pull out the staple 100 from the booklet P. As described above with respect to FIGS. 11A, 11B and the like, the removing part 5C includes the wedge part assembly 50C, and the drive unit 51C configured to drive the wedge part assembly 50C. The wedge part assembly 50C includes the wedge part 500C, and the support part 501C to which the wedge part 500C is attached. The removing part 5C has such a configuration that the wedge part 500C rotates about the shaft 520C as a support point supported to a frame 22C.

In the staple removing device 1D, the operation of guiding the closed booklet P bound in the two-fold bookbinding manner to the aligning part 2B by the first guide part 41B and the second guide part 42B without opening the booklet is similar to the staple removing device 1B.

That is, in the staple removing device 1D, when the booklet P is inserted between the first guide part 41B and the second guide part 42B, the fold P1 of the booklet P is guided to a position in which it is in contact With the aligning part 2B, while the fold P1 of the booklet P is directed along the length direction of the aligning part 2B. Thereby, the staple removing device 1D has also the guide part 4B, so that it is possible to easily set the booklet P in the predetermined position in which the staple 100 can be removed.

Also, the guide part 4B has the index parts 43B and 44B, so that it is possible to more easily set the booklet P in the predetermined position in which the staple 100 can be removed.

In the staple removing device 1D, the operation of removing the staple 100 from the booklet P by the removing part 5C is similar to the staple removing device 1C, and the wedge part 500C enters between the crown portion 101 of the staple 100 and the booklet P by rotation about the shaft 520C as a support point, thereby removing the staple 100 from the booklet P. The staple 100 removed from the booklet P falls into the staple wastebasket 7B by its own weight.

Figure 15A:
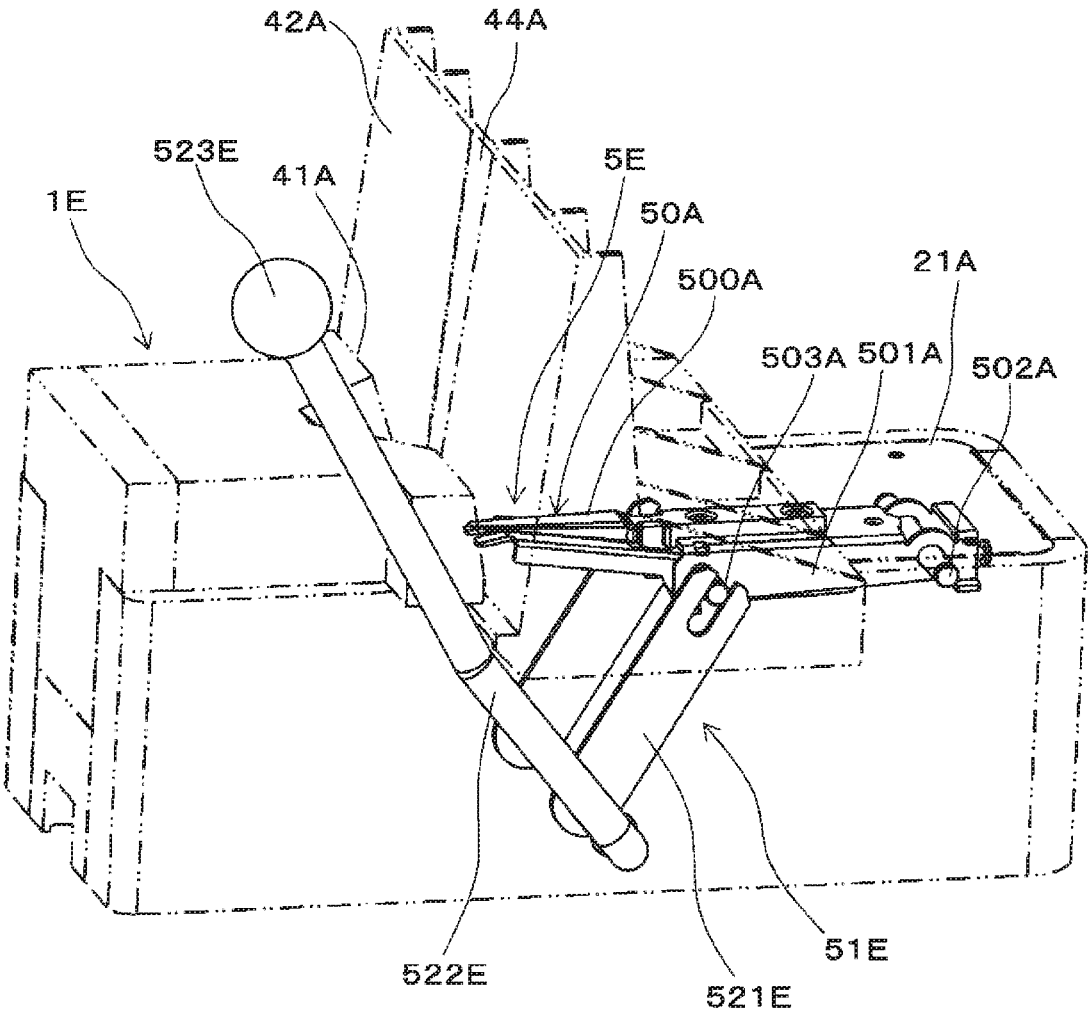
FIG. 15A is a perspective view depicting still another example of the staple removing device of another embodiment (a modified embodiment for manually operating the removing part).
Figure 15B:
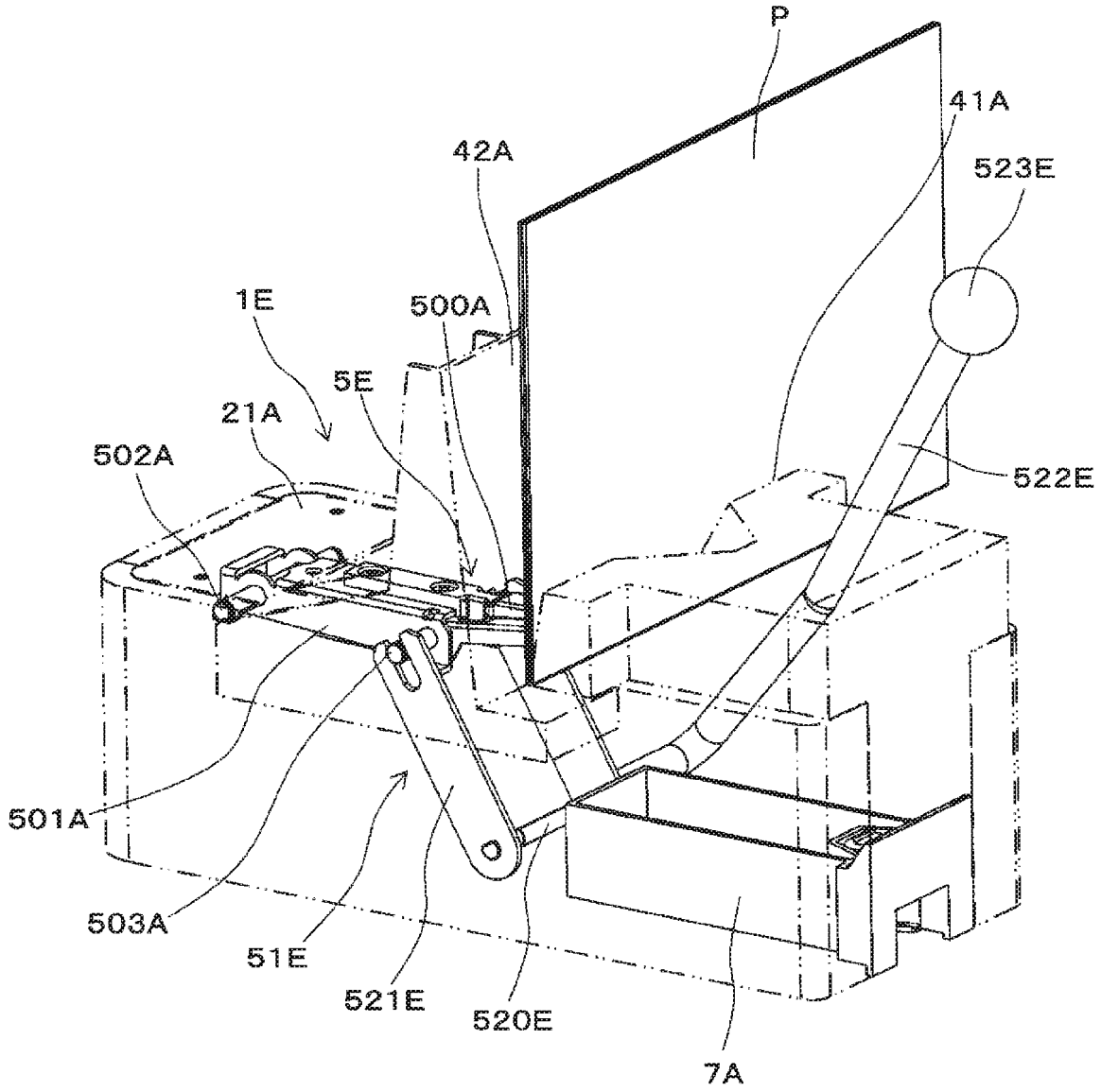
FIG. 15B is a perspective view depicting still another example of the staple removing device of another embodiment (a modified embodiment for manually operating the removing part).
Figure 15C:
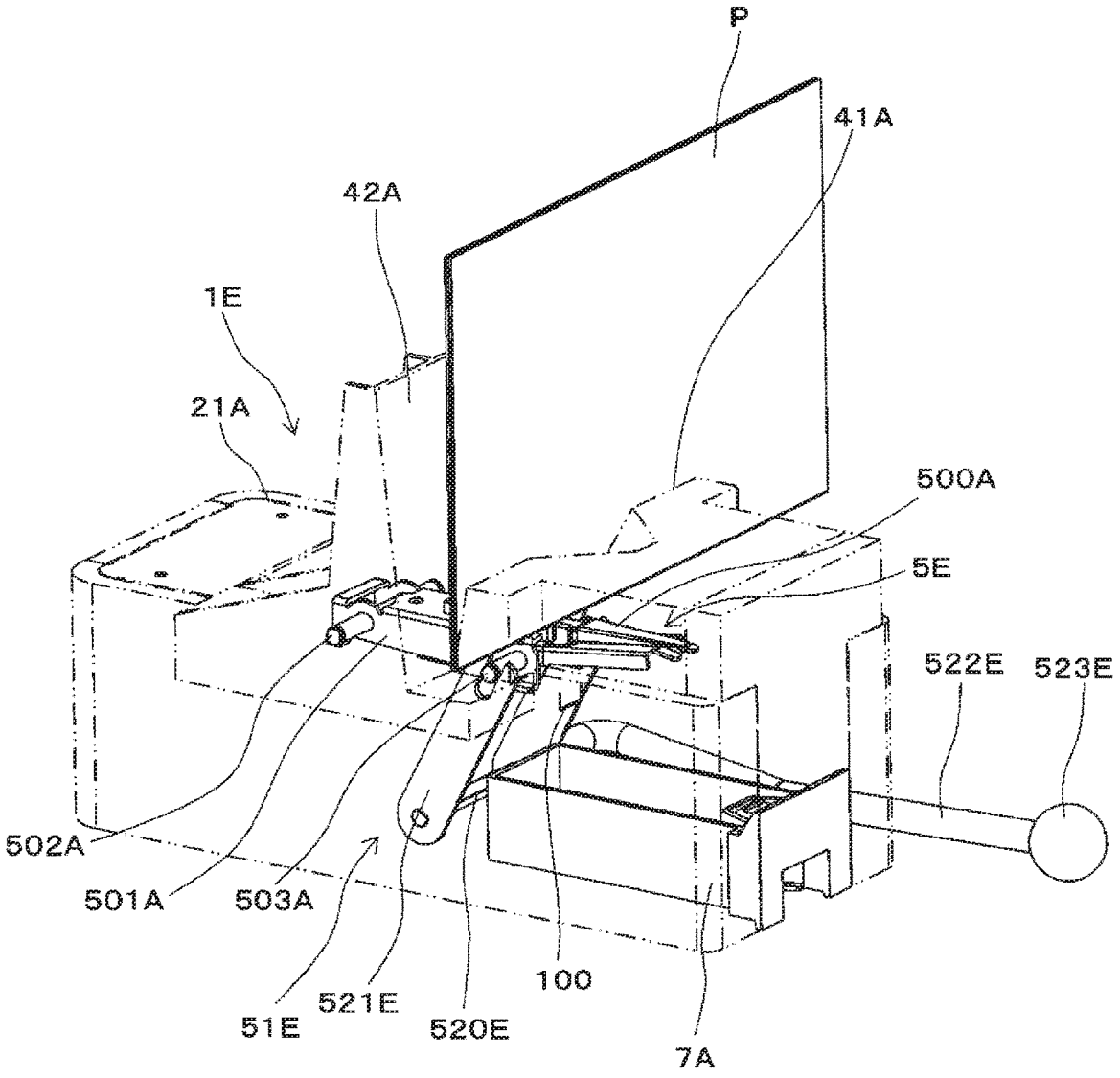
FIG. 15C is a perspective view depicting still another example of the staple removing device of another embodiment (a modified embodiment for manually operating the removing part).

FIGS. 15A, 15B and 15C are perspective views depicting still another example of the staple removing device of another embodiment.

A staple removing device 1E of still another example of another embodiment corresponds to a modified embodiment of the removing part of the staple removing device 1A, and is configured to manually operate the removing part. Therefore, in the staple removing device 1E, the aligning part 2A with which the fold P1 of the booklet P is brought into contact, the opening portion 3A (not shown, in FIGS. 15A to 15C) that the crown portion 101 of the staple 100 that stitches the booklet P enters when the fold P1 of the booklet P is brought into contact with the aligning part 2A, and the guide part 4A configured to guide the fold P1 of the booklet P to the aligning part 2A may have configurations similar to the staple removing device 1A of the first embodiment. In the example, the removing part is manually operated and the other parts are similar to the parts of the staple removing device 1A in the first embodiment. However, the other parts may be similar to the parts of the staple removing device 1A in the second embodiment.

The staple removing device 1E includes a removing part 5E configured to pull out the staple 100 from the booklet P. The removing part 5E includes the wedge plate assembly 50A, and a drive unit 51E configured to drive the wedge plate assembly 50A. As described above, the wedge plate assembly 50A includes the wedge plate 500A, and the support part 501A to which the wedge plate 500A is attached. The removing part 5E is configured so that the wedge plate 500A can reciprocally move between the standby position and the operation position by linear movement resulting from guiding of the shaft 502A and the shaft 503A and rotation about the shaft 503A as a shaft.

The drive unit 51E includes a link 521E configured to rotate about a shaft 520E as a support point, and a lever 522E for rotating the link 521E. The link 521E has one end portion supported to the shaft 520E, so that the link rotates in conjunction with the shaft 520E. Also, the link 521E has the other end portion coupled to the shaft 503A of the support part 501A. The lever 522E has one end portion supported to the shaft 520E, so that the lever rotates in conjunction with the shaft 520E, Also, the lever 522E has a handle part 523E provided at the other end portion and configured to be operable with a hand.

In the staple removing device 1E, when the handle part 523E is operated with a hand and the lever 522E rotates about the shaft 520E as a support point, the link 521E rotates about the shaft 520E as a support point, in conjunction with the shaft 520E. The link 521E of the removing part 5E rotates, so that the drive force is transmitted to the wedge plate assembly 50A.

In the staple removing device 1E, when the handle part 523E is operated with a hand and the lever 522E rotates about the shaft 520E as a support point, the wedge plate 500A moves in a direction in which it comes close to the crown portion 101 of the staple 100 that stitches the booklet P from the standby position, and enters between the crown portion 101 and the booklet P.

When the wedge plate 500A further moves in the direction from the standby position toward the operation position in the state where the wedge plate 500A enters between the crown portion 101 of the staple 100 and the booklet P, the force of pulling out the staple 100 from the booklet P is applied to the staple 100, so that the leg portions 102 are erected and pulled out from the booklet P and the staple 100 removed from the booklet P falls into the staple wastebasket 7A by its own weight, as shown in FIG. 15C.

In the staple removing device 1E, after moving the wedge plate 500A to the operation position in which the staple 100 is pulled out from the booklet P, when the handle part 523E is operated with a hand and the lever 522E rotates reversely about the shaft 520E as a support point, the wedge plate 500A moves from the operation position to the standby position.

By the above operation, the staple removing device 1E can set the closed booklet P bound in the two-fold bookbinding manner and remove the staple 100, without opening the booklet, by the configuration of operating manually the wedge plate 500A of the removing part 5E.

Figure 16A:
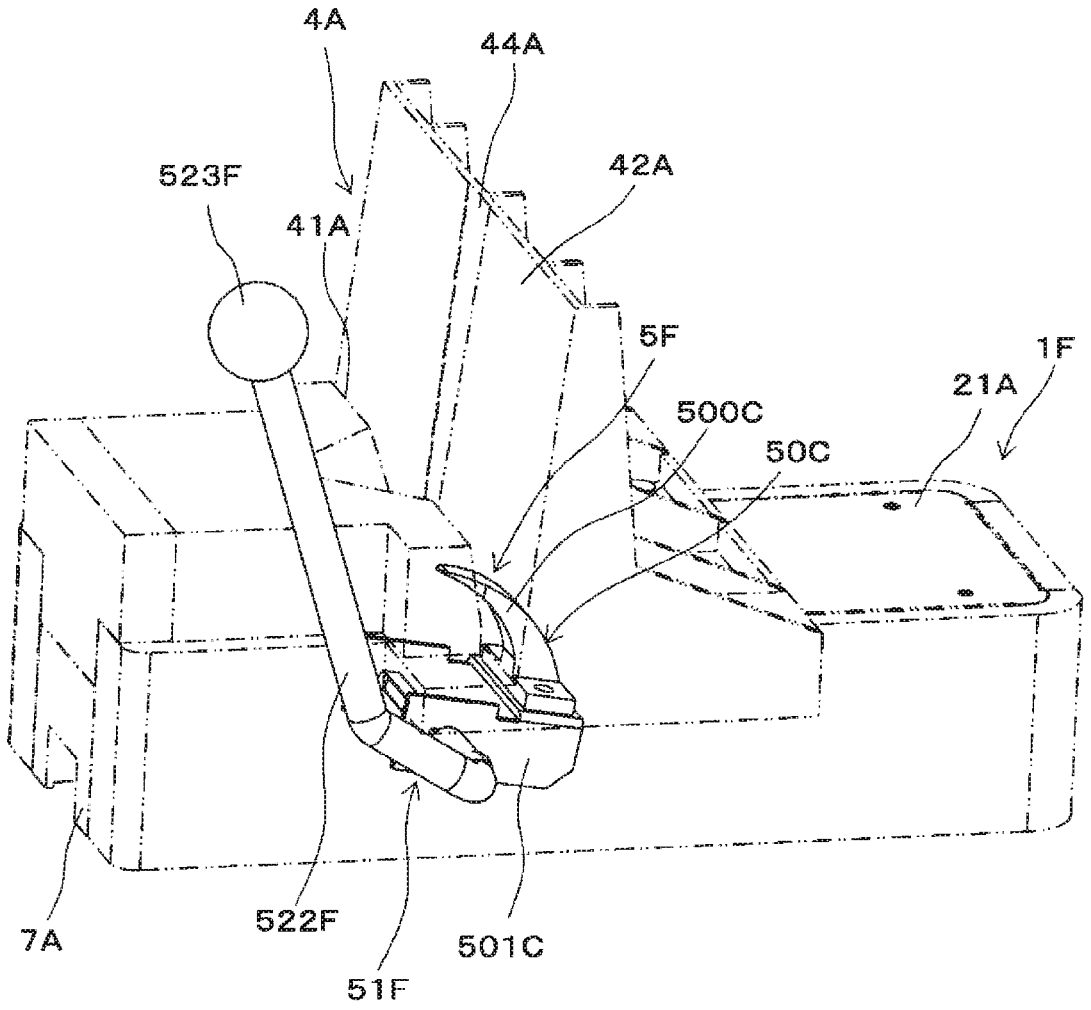
FIG. 16A is a perspective view depicting still another example of the staple removing device of another embodiment (a modified embodiment for manually operating the removing part).
Figure 16B:
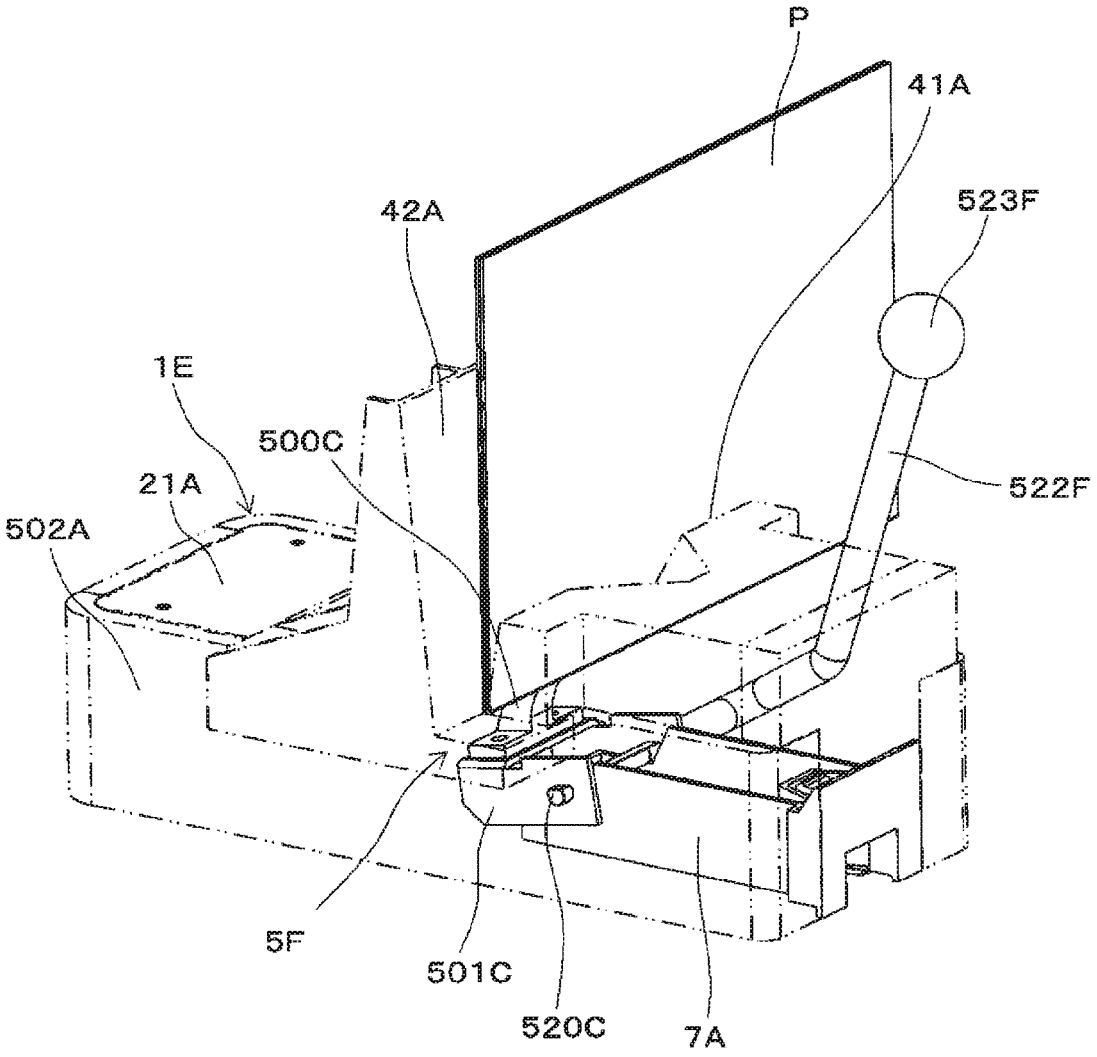
FIG. 16B is a perspective view depicting still another example of the staple removing device of another embodiment (a modified embodiment for manually operating the removing part).
Figure 16C:
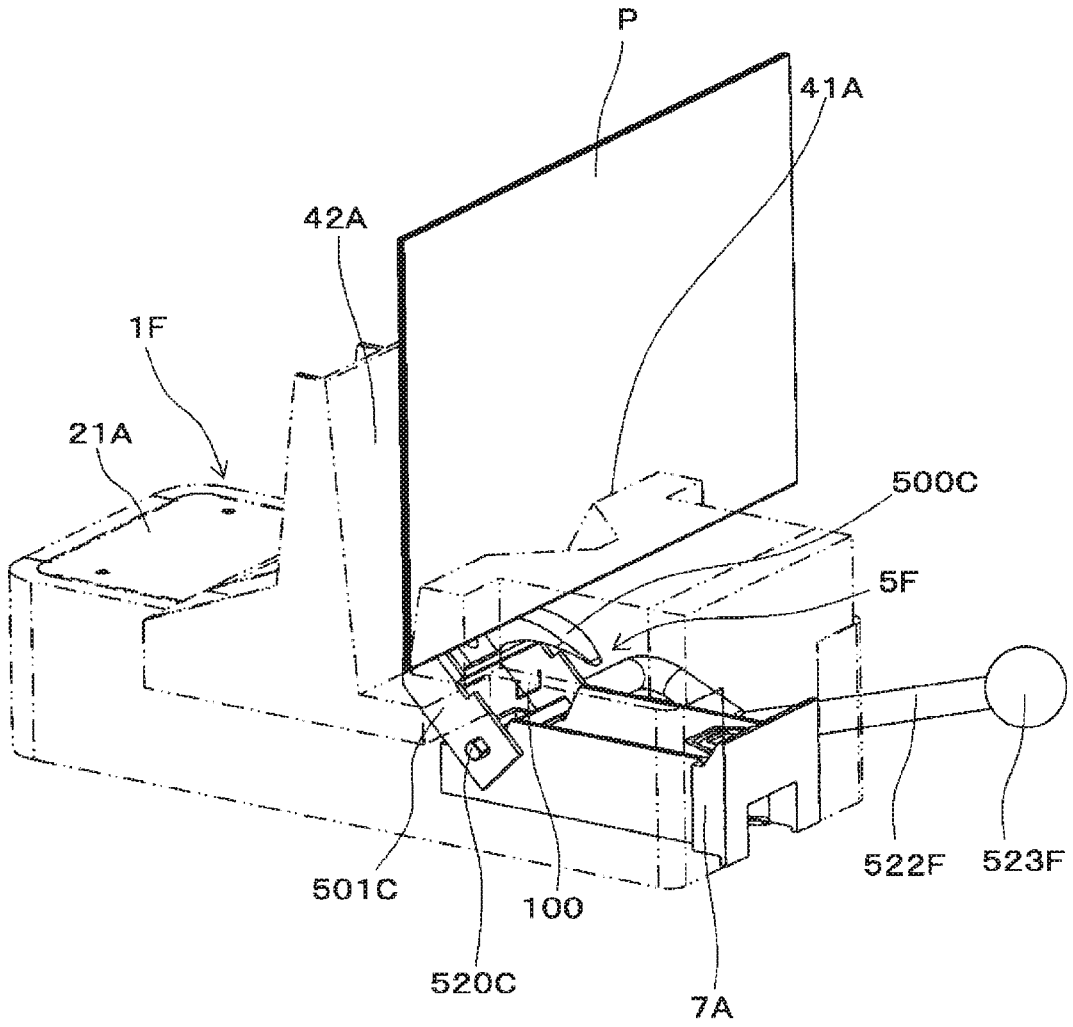
FIG. 16C is a perspective view depicting still another example of the staple removing device of another embodiment (a modified embodiment for manually operating the removing part).

FIGS. 16A, 16B and 16C are perspective views depicting still another example of the staple removing device of another embodiment.

A staple removing device 1F of still another example of another embodiment corresponds to a further modified embodiment of the removing part of the staple removing device 1C that is a modified embodiment of the staple removing device 1A, and is configured to manually operate the removing part, Therefore, in the staple removing device 1F, the aligning part 2A with Which the fold P1 of the booklet P is brought into contact, the opening portion 3A (not shown, in FIGS. 16A to 16C) that the crown portion 101 of the staple 100 that stitches the booklet P enters when the fold P1 of the booklet P is brought into contact with the aligning part 2A, and the guide part 4A configured to guide the fold P1 of the booklet P to the aligning part 2A may have configurations similar to the staple removing device 1A of the first embodiment. In the example, the removing part is manually operated and the other parts are similar to the parts of the staple removing device 1A in the first embodiment. However, the other parts may be similar to the parts of the staple removing device 1A in the second embodiment.

The staple removing device 1F includes a removing part 5F configured to pull out the staple 100 from the booklet P. The removing part 5F includes the wedge part assembly 50C, and a drive unit 51F configured to drive the wedge part assembly 50C. As described above, the wedge part assembly 50C includes the wedge part 500C, and the support part 501C to which the wedge part 500C is attached. The removing part 5F is configured so that the wedge part 500C can reciprocally move between the standby position and the operation position by rotation about the shaft 520C as a support point.

The drive unit 51F includes a lever 522F for rotating the shaft 520C. The lever 522F has one end portion supported to the shaft 520C, so that the lever rotates in conjunction with the shaft 520C. Also, the lever 522F has a handle part 523F provided at the other end portion and configured to be operable with a hand.

In the staple removing device 1F, when the handle part 523F is operated with a hand and the lever 522F rotates about the shaft 520C as a support point, the support part 501C rotates about the shaft 520C as a support point, so that the wedge part 500C rotates in a direction in which it comes close to the crown portion 101 of the staple 100 that stitches the booklet P from the standby position, and enters between the crown portion 101 and the booklet P.

When the wedge part 500C rotates in the direction from the standby position toward the operation position in the state where the wedge part 500C enters between the crown portion 101 of the staple 100 and the booklet P, the force of pulling out the staple 100 from the booklet P is applied to the staple 100, so that the leg portions 102 are erected and pulled out from the booklet P and the staple 100 removed from the booklet P falls into the staple wastebasket 7A by its own weight, as shown in FIG. 16C.

In the staple removing device 1F, after rotating the wedge part 500C to the operation position in which the staple 100 is pulled out from the booklet P, when the handle part 523F is operated with a hand and the lever 522F rotates reversely about the shaft 520C as a support point, the wedge part 500C rotates from the operation position to the standby position.

By the above operation, the staple removing device 1F can set the closed booklet P bound in the two-fold bookbinding manner and remove the staple 100, without opening the booklet, by the configuration of operating manually the removing part 5F.

FIGS. 17A to 17D and 18A to 18D are perspective views depicting still other examples of the staple removing device of another embodiment.

Staple removing devices of still other examples of another embodiment correspond to further modified embodiments of the removing part of the staple removing device 1C that is a modified embodiment of the staple removing device 1A. A staple removing device 1G shown in FIGS. 17A to 17D has a configuration where when a plurality of places along the fold P1 of the booklet P bound in a two-fold bookbinding manner is stitched with the staples 100, the staples 100 at the plurality of places can be removed at the same time. Also, a staple removing device 1H shown in FIGS. 18A to 18D has a configuration where when a plurality of places along the fold P1 of the booklet P bound in a two-fold bookbinding manner is stitched with the staples 100, the staples 100 at the plurality of places can be removed at the same time, and can cope with the staples 100 arranged at different intervals.

The staple removing device 1G corresponds to the booklet P where two places along the fold P1 are stitched with the staples 100, for example, and has an opening portion that the crown portions 101 of the staples 100 that stitch the booklet P enter when the fold P1 of the booklet P is brought into contact with the aligning part 2A. The opening portion may have a configuration where openings are provided at a plurality of places in conformity to stitching positions of the staples 100 or may have a configuration where an opening having a length in which the staples 100 at a plurality of places along the fold P1 of the booklet P enter is provided.

Also, the guide part 4A configured to guide the fold P1 of the booklet P to the aligning part 2A has index parts 43A provided at a plurality of places of the surface of the first guide part 41A facing the second guide part 42A, in conformity to the stitching positions of the staples 100. Also, the guide part 4A has index parts 44A provided at a plurality of places of the surface of the second guide part 42A facing the first guide part 41A, in conformity to the stitching positions of the staples 100.

A removing part 5G configured to pull out the staple 100 from the booklet P includes a plurality of wedge part assemblies 50C provided in conformity to the stitching positions of the staples 100, and a drive unit 51G configured to drive each of the wedge parts assembly 50C in an interlocking manner. The wedge part assembly 50C includes the wedge part 500C, and the support part 501C to which the wedge part 500C is attached.

The removing part 5G has the plurality of support parts 501C attached to one shaft 520G at intervals in conformity to the stitching positions of the staples 100. Also, the drive unit 51G has a lever 522G for rotating the shaft 520G to which the plurality of support parts 501C is attached. The lever 522G has one end portion supported to the shaft 520G, so that the lever rotates in conjunction with the shaft 520G. Also, the lever 522G has a handle part 523G provided at the other end portion and configured to be operable with a hand.

In the staple removing device 1G, the closed booklet P is inserted between the first guide part 41A and the second guide part 42A configuring the guide part 4A, while the fold P1 stitched with the staples 100 is directed downward.

In the staple removing device 1G, when the booklet P is inserted between the first guide part 41A and the second guide part 42A, the fold P1 of the booklet P is guided to a position in which it is in contact with the aligning part 2A, while the fold P1 of the booklet P is directed along the length direction of the aligning part 2A.

Also, when the fold P1 of the booklet P is in contact with the aligning part 2A in a state where the positions of each of the crown portions 101 of the staples 100 that stitch the booklet P at the plurality of places along the fold P1 of the booklet P, in the present example, at the two places along the fold P1 are aligned with the opening portion (not shown), the crown portions 101 enter the opening portion.

Thereby, the staple removing device 1G has the guide part 4A, so that it is possible to easily set the booklet P in the predetermined position in which the staples 100 that stitch the plurality of places along the fold. P1 of the booklet P can be removed. Also, the guide part 4A of the staple removing device 1G has the index parts 43A and 44A, so that it is possible to more easily set the booklet P in the predetermined position in which the staples 100 that stitch the plurality of places along the fold P1 of the booklet P can be removed.

In the staple removing device 1G, when the handle part 523G is operated with a hand and the lever 522G rotates about the shaft 520G as a support point, each of the support parts 501C rotates about the shaft 520G as a support point, so that each of the wedge parts 500C rotates in a direction in which it comes close to the crown portion 101 of each of the staples 100 that stitch the booklet P from the standby position, and enters between the crown portion 101 and the booklet P.

Figure 17A:
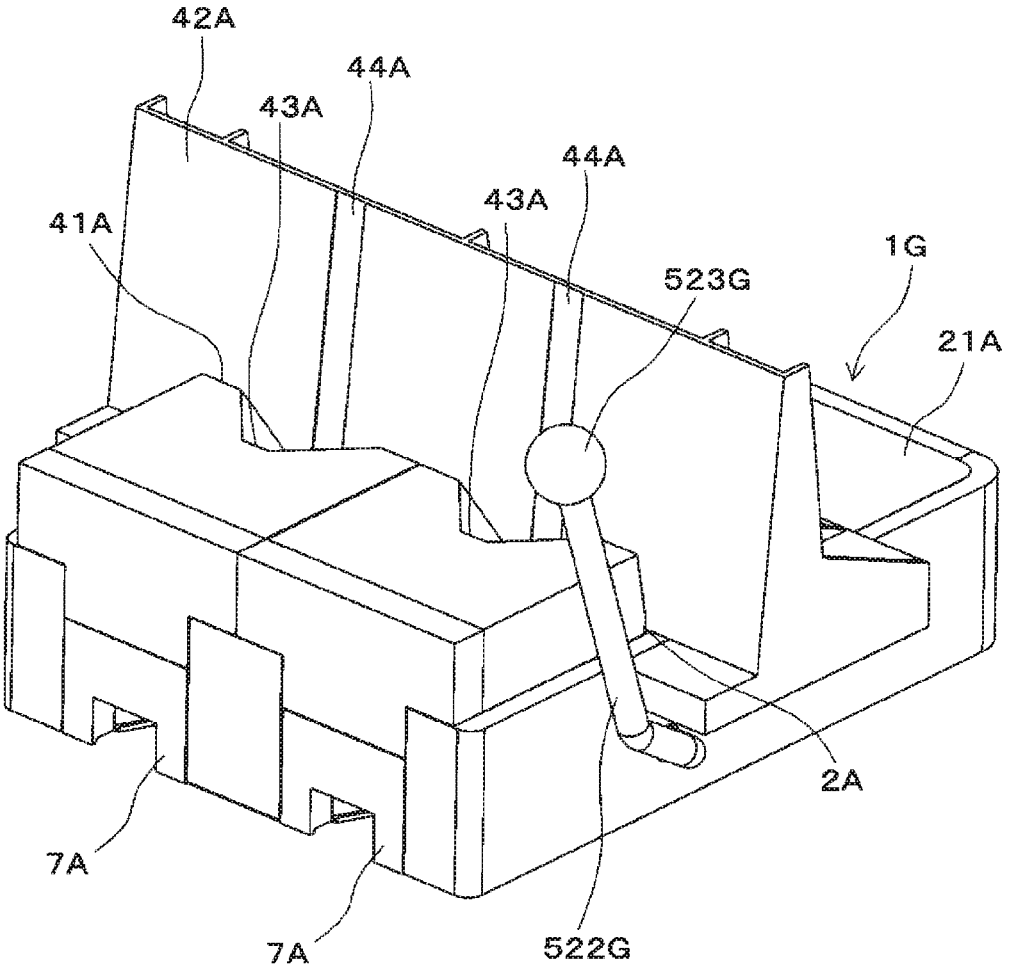
FIG. 17A is a perspective view depicting still another example of the staple removing device of another embodiment.
Figure 17B:
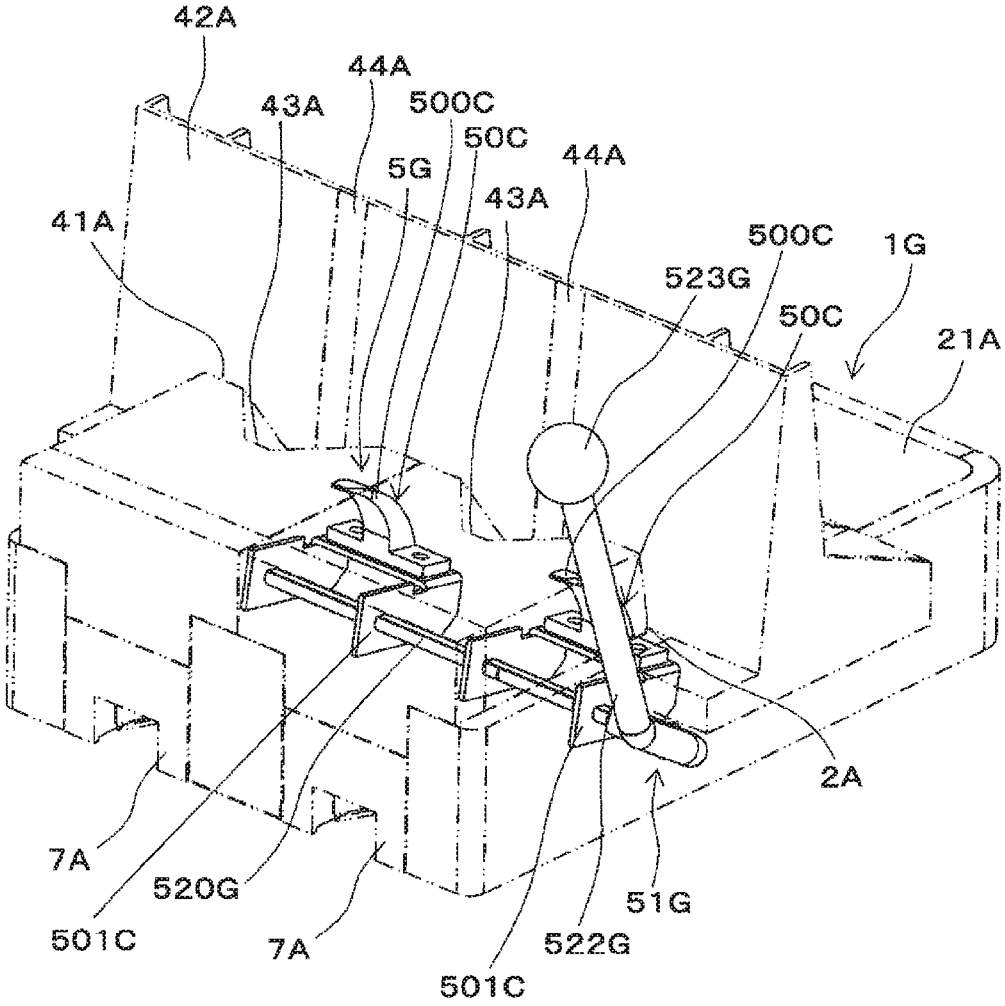
FIG. 17B is a perspective view depicting still another example of the staple removing device of another embodiment.
Figure 17C:
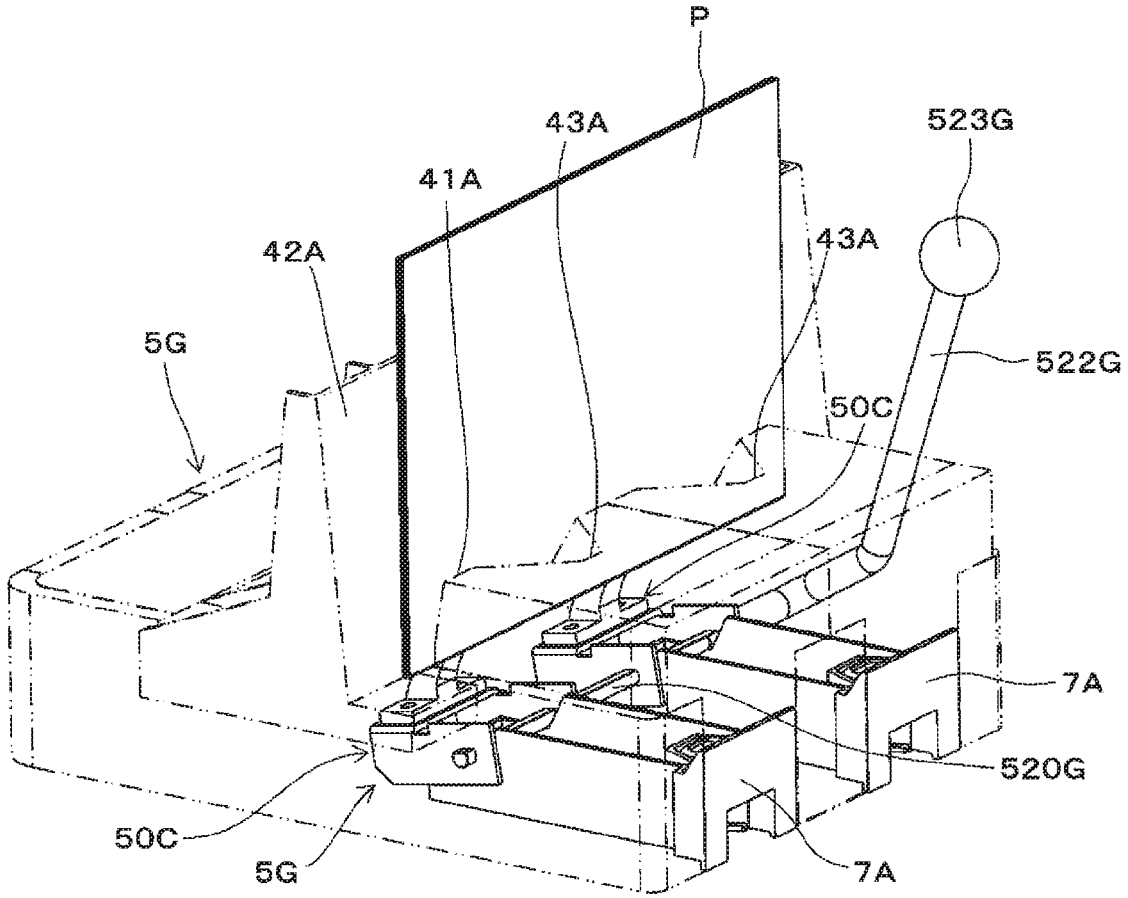
FIG. 17C is a perspective view depicting still another example of the staple removing device of another embodiment.
Figure 17D:
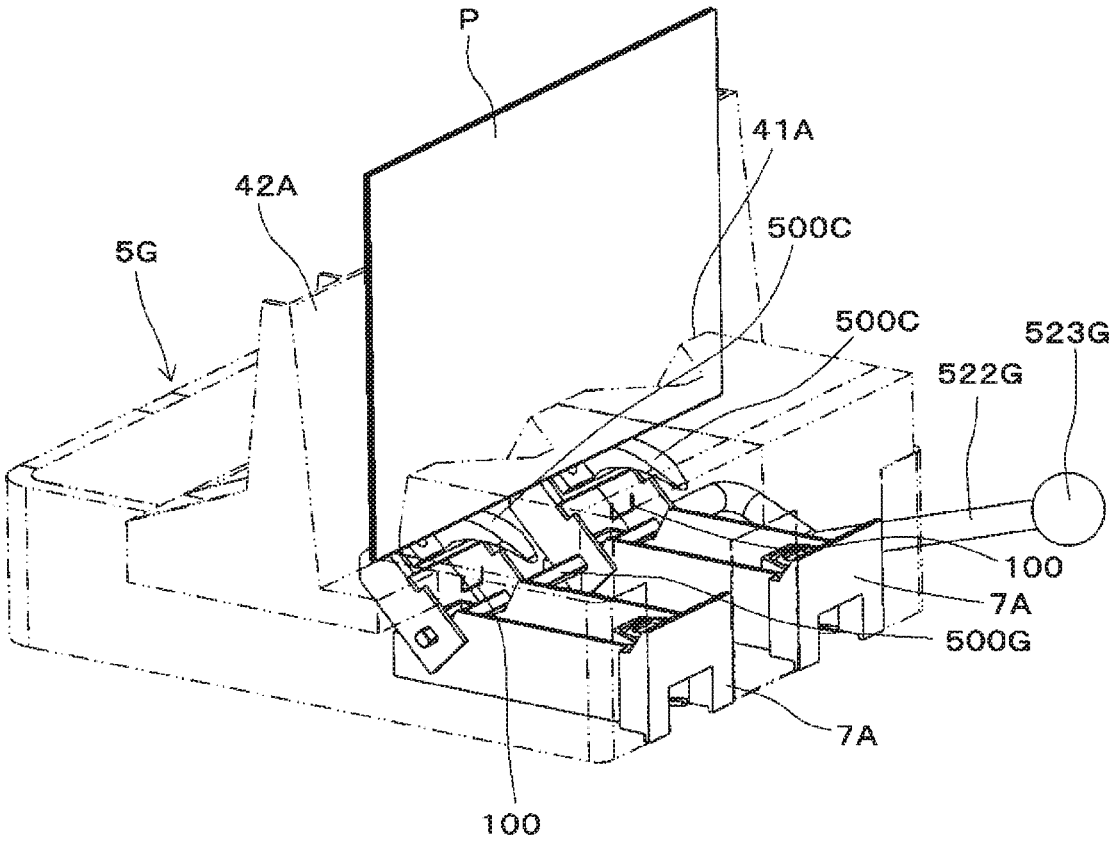
FIG. 17D is a perspective view depicting still another example of the staple removing device of another embodiment.

When the wedge part 500C rotates in the direction from the standby position toward the operation position in the state where each of the wedge parts 500C enters between the crown portion 101 of each of the staples 100 and the booklet P, the force of pulling out the staple 100 from the booklet P is applied to the staple 100, so that the leg portions 102 are erected and pulled out from the booklet P and the staple 100 removed from the booklet P falls into the staple wastebasket 7A by its own weight, as shown in FIG. 17D.

In the staple removing device 1G, after rotating the wedge part 500C to the operation position in which the staple 100 is pulled out from the booklet P, when the handle part 523G is operated with a hand and the lever 522G rotates reversely about the shaft 520G as a support point, each of the wedge parts 500C rotates from the operation position to the standby position.

By the above operation, the staple removing device 1G can set the booklet P stitched at the plurality of places along the fold P1 by the staples 100 as it is closed, without opening the booklet bound in the two-fold bookbinding manner, and remove each of the staples 100.

The staple removing device 1H corresponds to the booklet P stitched at two places along the fold P1 by the staples 100, for example. Also, in order to cope with a case where the interval between the staples 100 at two places is different, the guide part 4H that guides the fold P1 of the booklet P to the aligning part 2A has a configuration where the first guide part 41H and the second guide part 42H are each divided into two.

Also, the guide part 4H has index parts 43H provided on surfaces of each of the first guide parts 41H facing each of the second guide parts 42H, and index part 44H provided on surfaces of each of the second guide parts 42H facing each of the first guide parts 41H.

Figure 18A:
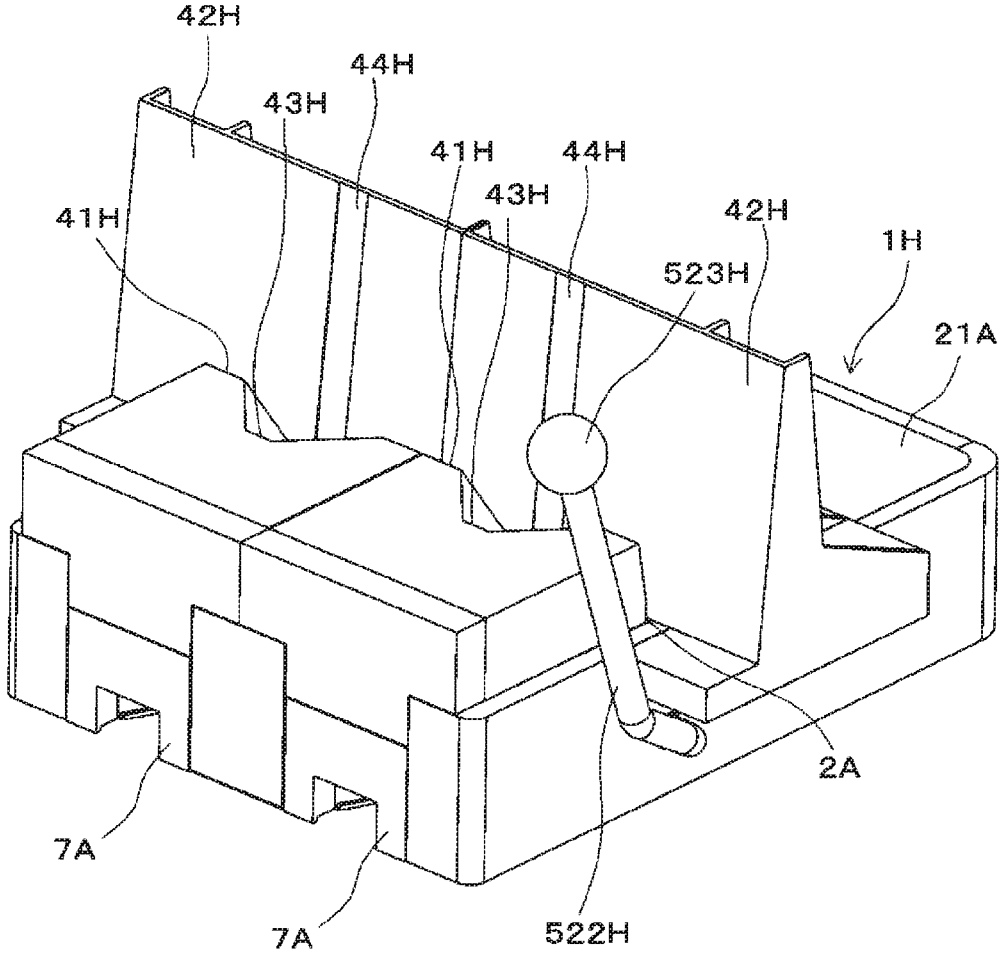
FIG. 18A is a perspective view depicting still another example of the staple removing device of another embodiment.
Figure 18B:
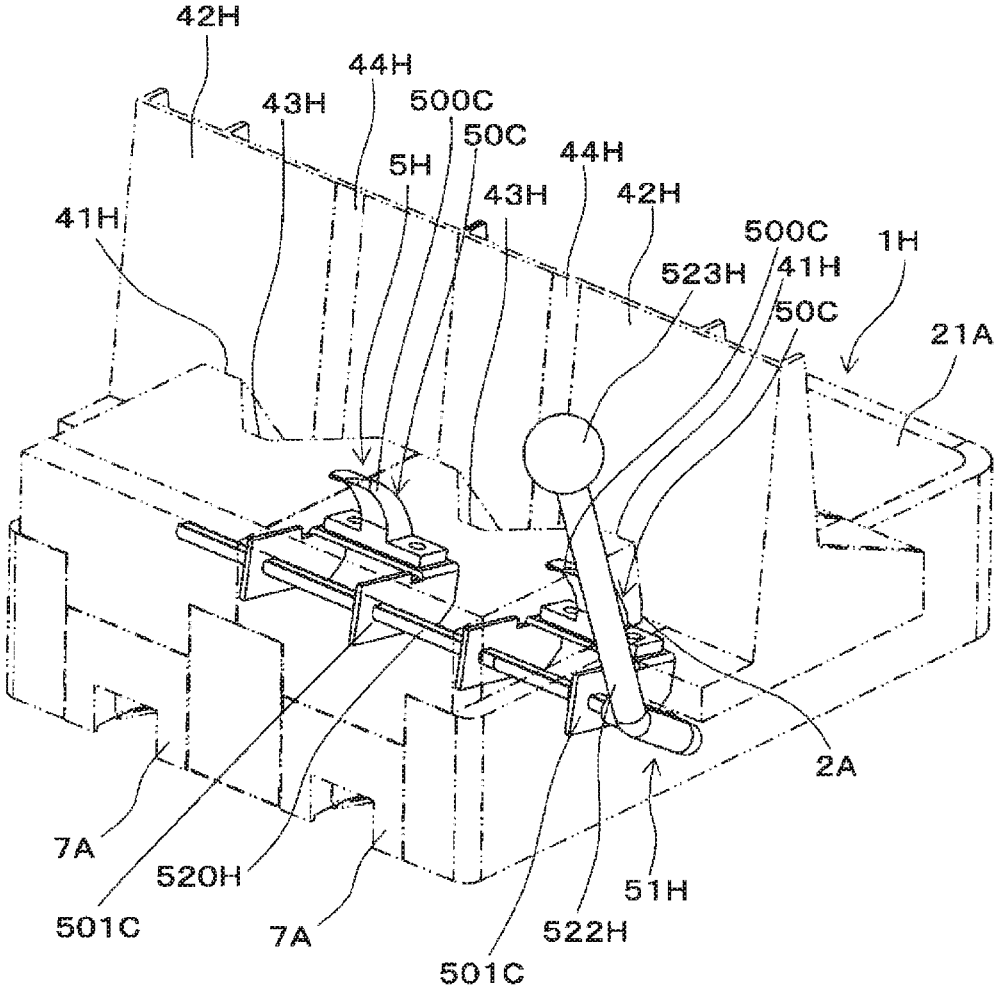
FIG. 18B is a perspective view depicting still another example of the staple removing device of another embodiment.
Figure 18C:
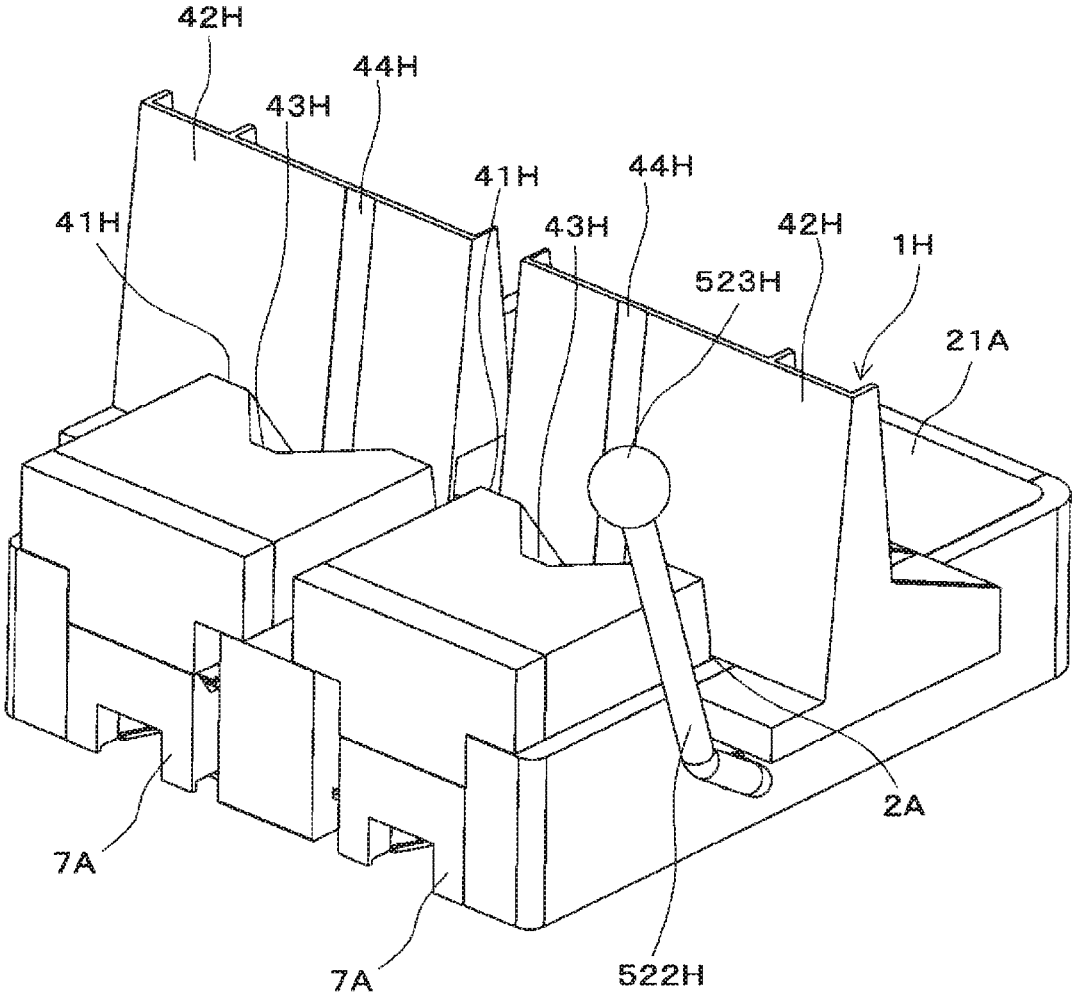
FIG. 18C is a perspective view depicting still another example of the staple removing device of another embodiment.

As shown in FIGS. 18A and 18C, the first guide part 41H and the second guide part 42H have a configuration where an interval along the length direction of the aligning part 2A is switched in an interlocking manner. Thereby, an interval between the pair of index parts 43H and an interval between the pair of index parts 44H can be adjusted to an interval conforming with the stitching positions of the staples 100.

Also, the staple removing device 1H has an opening portion that the crown portions 101 of the staples 100 that stitch the booklet P enter when the fold P1 of the booklet P is brought into contact with the aligning part 2A. The opening portion may have a configuration where an opening that changes in conjunction with switching of an interval between the first guide part 41H and the second guide part 42H in a length direction may be provided or may have a configuration where an opening having a length in which the staples 100 at a plurality of places along the fold P1 of the booklet P enter is provided.

A removing part 5H configured to pull out the staple 100 from the booklet P includes a plurality of wedge part assemblies 50C whose interval along the length direction of the aligning part 2A is switched in conformity to the stitching positions of the staples 100, and a drive unit 51H configured to drive each of the wedge part assemblies 50C in an interlocking manner. The wedge part assembly 500C includes the wedge part 500C, and the support part 501C to which the wedge part 500C is attached.

Figure 18D:
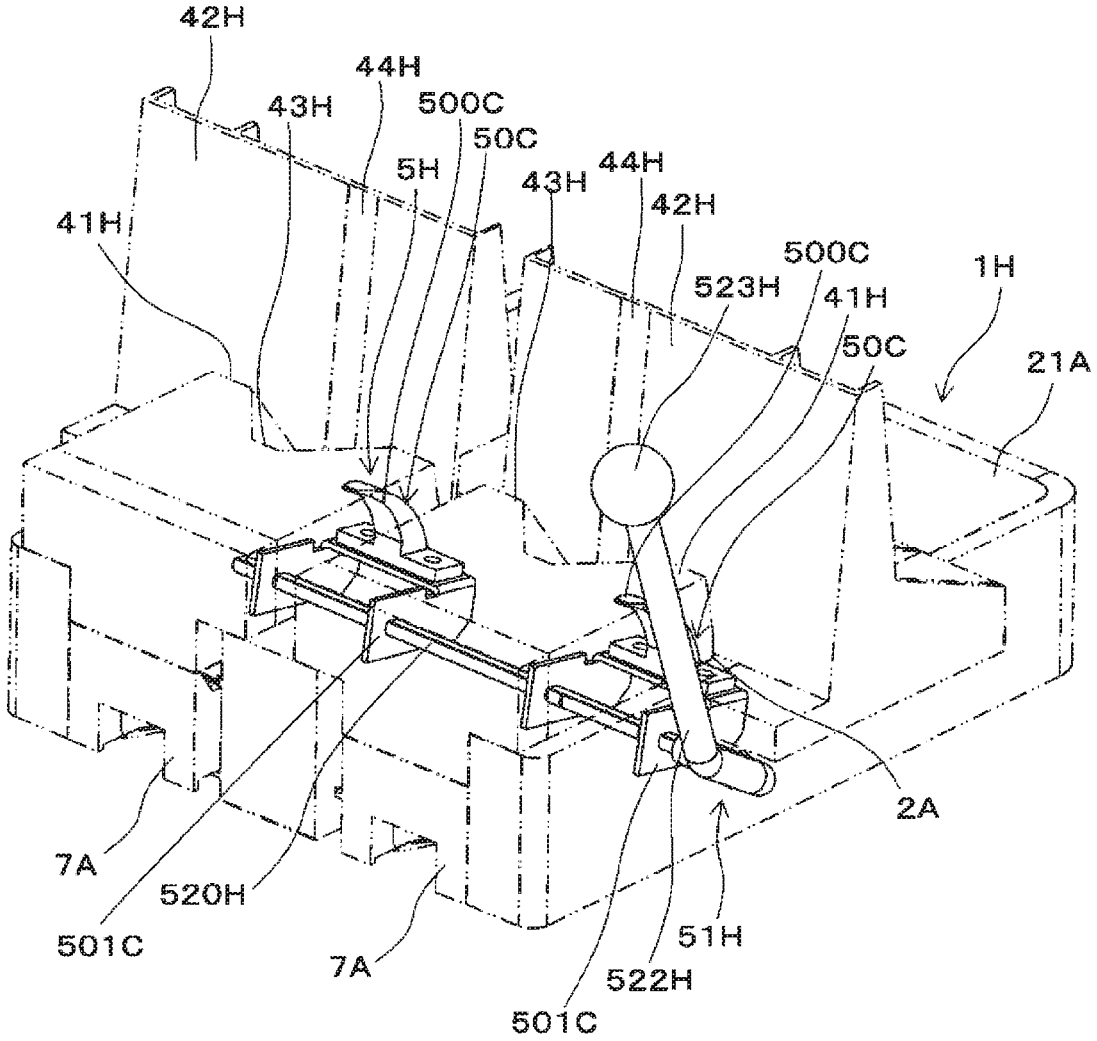
FIG. 18D is a perspective view depicting still another example of the staple removing device of another embodiment.

The removing part 5H has the plurality of support parts 501C attached to one shaft 520H so that an interval along the length direction of the aligning part 2A is switched in conformity to the stitching positions of the staples 100. Also, as shown in FIGS. 18B and 18D, the interval of the support parts 501C of the wedge part assembly 50C is switched in conjunction with the switching of the interval between the first guide part 41H and the second guide part 42H.

The drive unit 51H has a lever 522H for rotating the shaft 520H to which the plurality of support parts 501C is attached. The lever 522H has one end portion supported to the shaft 520H, so that the lever rotates in conjunction with the shaft 520H. Also, the lever 522H has a handle part 523H provided at the other end portion and configured to be operable with a hand.

In the staple removing device 1H, the closed booklet P is inserted between the first guide part 41H and the second guide part 42H configuring the guide part 4A, while the fold P1 stitched with the staples 100 is directed downward.

In the staple removing device 1H, when the booklet P is inserted between the first guide part 41H and the second guide part 42H, the fold P1 of the booklet P is guided to a position in which it is in contact with the aligning part 2A, while the fold P1 of the booklet P is directed along the length direction of the aligning part 2A.

Also, when the fold P1 of the booklet P is in contact with the aligning part 2A in a state where the interval between the first guide part 41H and the second guide part 42H is switched in conformity to the interval between the positions of each of the crown portions 101 of the staples 100 that stitch the booklet P at the plurality of places along the fold P1 of the booklet P, in the present example, at the two places along the fold P1 and the positions of the positions of each of the crown portions 101 are thus aligned with the opening portion (not shown), the crown portions 101 enter the opening portion.

Thereby, the staple removing device 1G has the guide part 4H, so that it is possible to easily set the booklet P in the predetermined position in which the staples 100 that stitch the plurality of places along the fold P1 of the booklet P can be removed. Also, the guide part 4H of the staple removing device 1H has the index parts 43H and 44H, so that it is possible to more easily set the booklet P in the predetermined position in which the staples 100 that stitch the plurality of places along the fold P1 of the booklet P can be removed even though the stitching positions of the staples 100 are different.

In the staple removing device 1H, when the handle part 523H is operated with a hand and the lever 522H rotates about the shaft 520H as a support point, each of the support parts 501C rotates about the shaft 520G as a support point, so that each of the wedge parts 500C rotates in a direction in which it comes close to the crown portion 101 of each of the staples 100 that stitch the booklet P from the standby position, and enters between the crown portion 101 and the booklet P.

When the wedge part 500C rotates in the direction from the standby position toward the operation position in the state where each of the wedge parts 500C enters between the crown portion 101 of each of the staples 100 and the booklet P, the force of pulling out the staple 100 from the booklet P is applied to the staple 100, so that the leg portions 102 are erected and pulled out from the booklet P and the staple 100 removed from the booklet P falls into the staple wastebasket 7A by its own weight.

In the staple removing device 1H, after rotating the wedge part 500C to the operation position in which the staple 100 is pulled out from the booklet P, when the handle part 523H is operated with a hand and the lever 522H rotates reversely about the shaft 520H as a support point, each of the wedge parts 500C rotates from the operation position to the standby position.

By the above operation, the staple removing device 1H can set the booklet P stitched at the plurality of places along the fold P1 by the staples 100 as it is closed, without opening the booklet bound in the two-fold bookbinding manner, and remove each of the staples 100. Also, the staple removing device 1H can also cope with the case where the stitching positions of the staples 100 along the fold P1 are different. In the example, the removing part is manually operated. However, the removing part may be automatically operated in a similar manner as the first embodiment. In the example, the wedge part rotates. However, the wedge part may linearly move. And the fold may be horizontally set in a similar manner as the second embodiment.

<Examples of Guide>

The guide of the present invention is a guide that is attached to the staple removing device 1A of the first embodiment including the aligning part 2A with which the fold P1 of the booklet P stitched by the staple 100 having the crown portion 101 and the leg portions 102 and folded along the extension direction of the crown portion 101 is brought into contact; and the removing part 5A having the wedge part 500A, which is an operating part configured to move in the direction intersecting with the fold P1 of the booklet P, to engage with the crown portion 101 of the staple 100 that stitches the booklet P and to apply the force to the staple 100 in the direction of pulling out the staple 100 from the booklet P. The guide includes the guide part 4A configured to guide the fold P1 of the booklet P to the aligning part 2A. The guide can also be applied to the staple removing devices of the other embodiments.

The guide part 4A protrudes in the direction intersecting with the aligning part 2A, and has the first guide part 41A provided on a downstream side of the aligning part 2A with respect to the moving direction of the wedge plate 500A coming close to the crown portion 101. The guide may also be configured only by the first guide part 41A, and the first guide part 41A may be detachably mounted to the staple removing device 1A. The first guide 41A may be configured by a continuous surface for guiding the fold P1 of the booklet P toward the aligning part 2A. Also, the guide may have the first guide part 41A, and the second guide part 421A on an upstream side of the aligning part 2A. The guide may be configured so that the second guide part 42A can be detachably mounted to the staple removing device 1A. The second guide 42A may be configured by a continuous surface for guiding the fold P1 of the booklet P toward the aligning part 2A.

In the staple removing device 1A of the first embodiment and the staple removing devices of the other embodiments, the guide part 4A is not limited to the configuration where the facing surfaces of the first guide part 41A and the second guide part 42A have a tapered shape. For example, at least one of the facing surfaces of the first guide part 41A and the second guide part 42A may be configured to have a step shape or a curved shape so that the interval between the first guide part 41A and the second guide part 42A along the width direction of the aligning part 2A increases away from the aligning part 2A. Also, the facing surfaces of the first guide part 41A and the second guide part 42A may be configured to be parallel to each other along the direction orthogonal to the aligning part 2A.

Also in the staple removing device 1B of the second embodiment, the guide part 4B is not limited to the configuration where the surface of the second guide part 42B facing the first guide part 41B has a tapered shape. For example, the surface of the second guide part 42B facing the first guide part 41B may be configured to have a step shape or a curved shape so that the interval between the first guide part 41B and the second guide part 42B along the width direction of the aligning part 2B increases away from the aligning part 2B. Also, the facing surfaces of the first guide part 41B and the second guide part 42B may be configured to be parallel to each other along the direction orthogonal to the aligning part 2B.

According to the staple removing device, it is possible to mount the booklet in a predetermined position by the guide part and to pull out the staple from the booklet, without opening the booklet folded at the fold. The guide is attached to the staple removing device, so that the booklet can be set in a predetermined position and the staple can be pulled out from the booklet, without opening the booklet folded at the fold.

What is claimed is:

1. A staple removing device comprising:

an aligning part having a surface having such a shape that a length in a direction along a fold of a booklet is longer than a width in a direction along a thickness direction of the booklet such that the fold of the booklet is brought into contact with the surface, the booklet being stitched by a staple having a crown portion and leg portions and folded along an extension direction of the crown portion;

wherein the direction along the fold of the booklet is defined as a length direction and the direction along the thickness direction of the booklet is defined as a width direction, a wedge plate configured to move in the width direction to engage with the crown portion of the booklet which is in contact with the aligning part, and to pull out the staple from the booklet, and a first guide part protruding in a direction substantially intersecting with the length direction and the width direction and located on a downstream side of the aligning part with respect to a moving direction of the wedge plate toward the crown portion, the first guide part having a guide surface that guides the fold of the booklet to the aligning part.

2. The staple removing device according to claim 1, further comprising a second guide part located on an upstream side of the aligning part with respect to the moving direction of the wedge plate toward the crown portion, the second guide part having a surface facing the first guide part.

3. The staple removing device according to claim 2, wherein an interval between the first guide part and the second guide part decreases from a side distant from the aligning part toward the aligning part and is adjusted to a thickness of the booklet.

4. The staple removing device according to claim 3, wherein at least one of facing surfaces of the first guide part and the second guide part has an inclined surface inclined relative to a direction orthogonal to the aligning part.

5. The staple removing device according to claim 2, wherein at least one of the first guide part and the second guide part comprises an index part which aligns a position of the staple that stitches the booklet with a position of the wedge plate, and wherein the index part includes a surface having at least one of an uneven portion, a concave portion, a convex portion, an indentation or a printed matter.

6. The staple removing device according to claim 4, wherein at least one of the first guide part and the second guide part comprises an index part which aligns a position of the staple that stitches the booklet with a position of the wedge plate, and wherein the index part includes a surface having at least one of an uneven portion, a concave portion, a convex portion, an indentation or a printed matter.

7. The staple removing device according to claim 5, wherein the index part extends away from the alignment part in conformity to a position of the wedge plate.

8. The staple removing device according to claim 6, wherein the index part extends away from the alignment part in conformity to a position of the wedge plate.

9. The staple removing device according to claim 1, further comprising an opening portion formed in the aligning part, the crown portion of the staple that stitches the booklet entering the opening portion with the fold of the booklet in contact with the aligning part.

10. The staple removing device according to claim 4, further comprising an opening portion formed in the aligning part, the crown portion of the staple that stitches the booklet entering the opening portion with the fold of the booklet in contact with the aligning part.

11. A guide that is attached to a staple removing device, the staple removing device comprising:

an aligning part having a surface having such a shape that a length in a direction along a fold of a booklet is longer than a width in a direction along a thickness direction of the booklet such that the fold of the booklet is brought into contact with the surface, the booklet being stitched by a staple having a crown portion and leg portions and folded along an extension direction of the crown portion; and wherein the direction along the fold of the booklet is defined as a length direction and the direction along the thickness direction of the booklet is defined as a width direction, a wedge plate configured to move in the width direction, to engage with the crown portion of the booklet which is in contact with the aligning part, and to pull out the staple from the booklet;

the guide, when the guide is attached to the staple removing device, protruding in a direction substantially intersecting with the length direction and the width direction and located on a downstream side of the aligning part with respect to a moving direction of the wedge plate toward the crown portion, the guide having a guide surface that guides the fold of the booklet to the aligning part.

12. The guide according to claim 11, wherein the guide includes a second guide part located on an upstream side of the aligning part with respect to the moving direction of the wedge plate toward the crown portion when the guide is attached to the staple removing device.

* * * * *